US007312624B2

(12) United States Patent
Ishii

(10) Patent No.: US 7,312,624 B2
(45) Date of Patent: Dec. 25, 2007

(54) SUBSTRATE FOR ELECTRO-OPTICAL DEVICE, TESTING METHOD THEREOF, ELECTRO-OPTICAL DEVICE AND ELECTRONIC APPARATUS

(75) Inventor: Tatsuya Ishii, Fujimi-cho (JP)

(73) Assignee: Seiko Epson Corporation, Tokyo (JP)

( * ) Notice: Subject to any disclaimer, the term of this patent is extended or adjusted under 35 U.S.C. 154(b) by 82 days.

(21) Appl. No.: 11/295,432

(22) Filed: Dec. 7, 2005

(65) Prior Publication Data

US 2006/0226872 A1 Oct. 12, 2006

(30) Foreign Application Priority Data

Dec. 21, 2004 (JP) ..... 2004-368865
May 6, 2005 (JP) ..... 2005-134989

(51) Int. Cl.
*G00R 31/00* (2006.01)
*G09G 3/36* (2006.01)

(52) U.S. Cl. ..... 324/770; 345/87; 345/98

(58) Field of Classification Search ..... 326/81; 324/770, 763, 765
See application file for complete search history.

(56) References Cited

U.S. PATENT DOCUMENTS 5,377,030 A * 12/1994 Suzuki et al. ..... 349/187
6,864,703 B2 * 3/2005 Miyagawa et al. ..... 324/770
7,167,151 B2 * 1/2007 Yamashita ..... 345/98

FOREIGN PATENT DOCUMENTS

| | | | |
|---|---|---|---|
| JP | A 05-341302 | | 12/1993 |
| JP | A 07-333278 | | 12/1995 |
| JP | A 10-104563 | | 4/1998 |
| JP | A 2004-226551 | | 8/2004 |
| JP | A 2005-024558 | | 1/2005 |
| KR | A 2003-0008407 | | 1/2003 |
| KR | A 2003-0064467 | | 8/2003 |
| WO | WO 03/065339 | * | 8/2003 |
| WO | WO 03/65339 A1 | | 8/2003 |

* cited by examiner

*Primary Examiner*—Ernest Karlsen
(74) *Attorney, Agent, or Firm*—Oliff & Berridge, PLC

(57) ABSTRACT

A substrate for an electro-optical device includes amplifiers each has a first node and a second node, the first node connected to a signal line and being input with a first potential signal, the second node being input with a second potential signal, each amplifier outputting signals such that the potential of the first node is further decreased when the first potential signal is low, and the potential of the first node is further increased when the first potential signal is high. At least two signal lines correspond to at least one of the first and second nodes. A selection unit that selects one signal line. A connection unit connect the selected signal line to at least one of the first and second nodes.

7 Claims, 24 Drawing Sheets

FIG. 6A

| | 6 | 5 | 4 | 3 | 2 | 1 |
|---|---|---|---|---|---|---|
| 1 | L | H | L | H | L | H |
| 2 | L | H | L | H | L | H |
| 3 | L | H | L | H | L | H |
| 4 | L | H | L | H | L | H |

FIG. 6B

| | 6 | 5 | 4 | 3 | 2 | 1 |
|---|---|---|---|---|---|---|
| 1 | H | L | H | L | H | L |
| 2 | H | L | H | L | H | L |
| 3 | H | L | H | L | H | L |
| 4 | H | L | H | L | H | L |

| | 6 | 5 | 4 | 3 | 2 | 1 |
|---|---|---|---|---|---|---|
| 1 | M | H | M | H | M | H |
| 2 | M | H | M | H | M | H |
| 3 | M | H | M | H | M | H |
| 4 | M | H | M | H | M | H |

FIG. 18

| A1 | A0 | TE1 | TE2 | TE3 | TE4 |
|---|---|---|---|---|---|
| 0 | 0 | 1 | 0 | 0 | 0 |
| 0 | 1 | 0 | 1 | 0 | 0 |
| 1 | 0 | 0 | 0 | 1 | 0 |
| 1 | 1 | 0 | 0 | 0 | 1 |

SUBSTRATE FOR ELECTRO-OPTICAL DEVICE, TESTING METHOD THEREOF, ELECTRO-OPTICAL DEVICE AND ELECTRONIC APPARATUS

BACKGROUND

1. Technical Field

The present invention relates to a substrate for an electro-optical device, to a method of testing the same, to an electro-optical device, and to an electronic apparatus. More particularly, the present invention relates to a substrate for an electro-optical device having a plurality of pixels provided with a plurality of switching elements, to a method of testing the same, to an electro-optical device, and to an electronic apparatus.

2. Related Art

In general, display devices such as liquid crystal devices have been widely used in apparatuses such as cellular phones, projectors, or the like. The liquid crystal display devices using thin film transistors (TFTs) have a structure in which a TFT substrate and a counter substrate are bonded to each other and liquid crystal is inserted therebetween. A test for determining whether the manufactured liquid crystal device operates normally has been generally performed with respect to a finished product. For example, a predetermined image signal is input to the liquid crystal device as display data and projected and displayed, so that data is correctly displayed. However, in this case, it is checked whether defective pixels exist.

However, when adopting a method of performing the test for the finished product, there are cases in which defective products are discovered after a process of manufacturing the substrate. For this reason, the discovery of the defective products becomes delayed, which is not preferable in the management of the manufacturing process.

For example, a period until information about discovery of a defective product is fed back is lengthened at the time of the process management. As a result, a period for which a yield is lowered is lengthened, so that a manufacturing cost increases. Further, since a period until feedback is made is increased from an evaluation of a trial product to a design thereof even in the case of the trial product, a product development period is lengthened, which results in an increase in a product development cost. For this reason, after the product is finished, it is difficult to repair the defective product.

Accordingly, it has been required that a discovery of defective products, particularly, defective pixels of the display device are discovered in the process of manufacturing the substrate.

As one example of these test methods, a technology has been suggested in which a testing probe comes into contact with an electrode pad of a liquid crystal display device, a predetermined current is supplied thereto, and a test of the liquid crystal display device is performed (For example, JP-A-5-341302). Further, a technology has been suggested in which a predetermined voltage is applied to each pixel of a TFT substrate in accordance with a capacitance characteristic of the pixel, and a function of the TFT is tested on the basis of waveforms of a discharged current and a discharged voltage (for example, JP-A-7-333278).

Furthermore, a technology has been suggested in which an amount of changed potential of a pixel electrode is detected using a testing counter electrode corresponding to a pixel electrode of a TFT substrate, and an operation test of each pixel electrode is performed (for example, JP-A-10-104563).

In the technologies disclosed in JP-A-5-341302 and JP-A-10-104563, mechanical position precision is required in a test device such that a predetermined probe comes into contact with or comes close to the electrode pad from the outside of the substrate. As a result, there is a problem in that a detecting time is lengthened so as to obtain mechanical alignment precision. Further, in a case of testing a liquid crystal display device with high precision, since thin probes should be brought into contacts with a plurality of electrode pads through mechanical control, there are cases in which the above-mentioned technologies cannot be applied.

In addition, in general, the capacitanes of various capacitance components between the liquid crystal display device and a measurement device, for example, the capacitances in a source-line, an image signal line, and an electrode pad terminal are much larger than a capacitance of the pixel including an additional capacitance of the electrode. A voltage applied to the pixel electrode is determined according to a ratio between the capacitance of the source line and the capacitance of the pixel, and has a minute voltage level. For this reason, if the voltage held in the pixel is extracted from the electrode pad or the like, a noise having a large level overlaps the pixel potential having the minute level because of the capacitance of the source line, so that the measurement precision of the pixel holding voltage is extremely deteriorated, which results in insufficient measurement precision.

SUMMARY

An advantage of some aspects of the invention is that it provides a substrate for an electro-optical device capable of achieving a test with sufficient measurement precision without contacting with a probe and reducing an occupied area of a test circuit, a test method thereof, an electro-optical device, and an electronic apparatus.

According to a first aspect of the invention, a substrate for an electro-optical device includes: a plurality of scanning lines; a plurality of signal lines that are provided so as to cross the plurality of corresponding scanning lines; a plurality of pixel electrodes that are disposed in a matrix so as to correspond to intersections of the plurality of scanning lines and the plurality of signal lines; a plurality of amplifiers each of which has a first node and a second node, the first node being electrically connected to the corresponding signal line and being input with a first potential signal supplied to the pixel electrode, the second node being input with a second potential signal serving as a reference potential, each amplifier comparing a potential of the first potential signal with a potential of the second potential signal, and outputting signals corresponding to the potential of the first node is decreased when the first potential signal is low, and corresponding to the potential of the first node is increased when the first potential signal is high, each amplifier being provided such that a predetermined number of signal lines of the plurality of signal lines correspond to at least one of the first and second nodes; a selection unit that selects one signal line of the predetermined number of signal lines; and a connection unit that electrically connect the selected signal line to at least one of the first and second nodes of the amplifier.

According to this aspect, the connection unit makes the plurality of signals correspond to at least one of the first and second nodes of the amplifier. The selection unit selects one of the plurality of signal lines and connects it to the second node. Thereby, the potential of the pixel is supplied to the amplifier. The amplifier compares the first signal with the second signal, and converts it into a digital value. The output of the amplifier is extracted through, for example, the signal line. It is possible to determine whether the pixel is normal or abnormal through the output of the amplifier. The pluralities of signal lines correspond to at least one of the first and second node of the amplifier. The pixel test with respect to all signal lines can be performed by only using a small number of amplifiers. As such, the area occupied by the amplifier can be decreased. Alternatively, the area occupied by the amplifier can be increased and a size of a gate (length/width) constituting the amplifier can be increased. Therefore, the symmetry of the pair of transistors can be improved, so that it is possible to obtain an amplifier having high performance.

Preferably, in each amplifier, the second node is electrically connected to the signal line, and the signals of the same number correspond to each of the first node and the second node.

According to this aspect, it is possible to uniform the influence from the signal line with respect to the first and second nodes and thus to improve the test precision.

Preferably, in each amplifier, the second node is electrically connected to a supply line for supplying the second potential signal.

Preferably, the selection unit has a decode circuit that generates an output signal for determining a signal line connected to the first node or the second node of the amplifier on the basis of selection information.

According to this aspect, through the decode circuit, the signal lines connected to the first or second node can easily be determined from the selection information.

According to a second aspect of the invention, an electro-optical device includes: a pair of substrates; and an electro-optical material that is inserted between the pair of substrates. The substrate for an electro-optical device is used as one of the pair of substrates.

According to a third aspect of the invention, an electronic apparatus includes the above-mentioned electro-optical device.

According to this aspect, it is possible to achieve a substrate for an electro-optical device capable of achieving a test with sufficient accuracy without providing a probe additionally, a test method thereof, an electro-optical device, and an electronic apparatus.

According to a fourth aspect of the invention, a method of testing a substrate for an electro-optical device which includes a plurality of scanning lines, a plurality of signal lines that are provided so as to cross the plurality of corresponding scanning lines, and a plurality of pixel electrodes that are disposed in a matrix so as to correspond to intersections of the plurality of scanning lines and the plurality of signal lines, the method includes: in a plurality of amplifiers each of which has a first node and a second node, the first node being electrically connected to the corresponding signal line and being input with a first potential signal supplied to the pixel electrode, the second node being input with a second potential signal serving as a reference potential, each amplifier being provided such that a predetermined number of signal lines of the plurality of signal lines correspond to at least one of the first and second nodes, selecting one signal line of the predetermined number of signal lines; electrically connecting the selected one signal line to the corresponding first or second node; supplying the first potential signal supplied to the pixel to one of the first and second nodes through the electrically connected signal line while supplying the second potential signal to the other; and outputting signals such that by comparing a potential of the first potential signal with a potential of the second potential signal, the potential of the first node is further decreased when the first potential signal is low, and the potential of the first node is further increased when the first potential signal is high.

According to this aspect, a predetermined signal line is connected to the first or second node. The potential of the pixel is applied to the amplifier through the signal line connected to the first or second node. The amplifier compares the first and second potential signals supplied to the first and second nodes with each other, and outputs the potential such that the potential of the first node is further decreased when the first potential signal is low, and the potential of the first node is further increased when the first potential signal is high. Thereby, it can be determined whether the pixel is normal or abnormal.

BRIEF DESCRIPTION OF THE DRAWINGS

The invention will be described with reference to the accompanying drawings, wherein like numbers reference like elements, and wherein:

FIG. 6 is a diagram illustrating a test method.

FIG. 18 is a diagram illustrating a truth value table of a gate decode circuit 47.

DESCRIPTION OF EXEMPLARY EMBODIMENTS

Hereinafter, preferred embodiments of the invention will be described in detail with reference to accompanying drawings.

Here, a substrate for an active-matrix-type display device used in a liquid crystal display device will be described as an example of a substrate for an electro-optical device according to the invention.

First Embodiment

According to the first embodiment, a test circuit is mounted in a substrate and an occupied area of the test circuit in the substrate is reduced. Alternatively, according to the first embodiment, an occupied area per differential amplifier constituting the test circuit is increased, so that the performance of the test circuit is improved. For the sake of convenience, first, a substrate for an electro-optical device will be described in which the test circuit according to the present embodiment is mounted and an occupied area is not considered.

FIRST EXAMPLE OF SUBSTRATE

Figure 1:
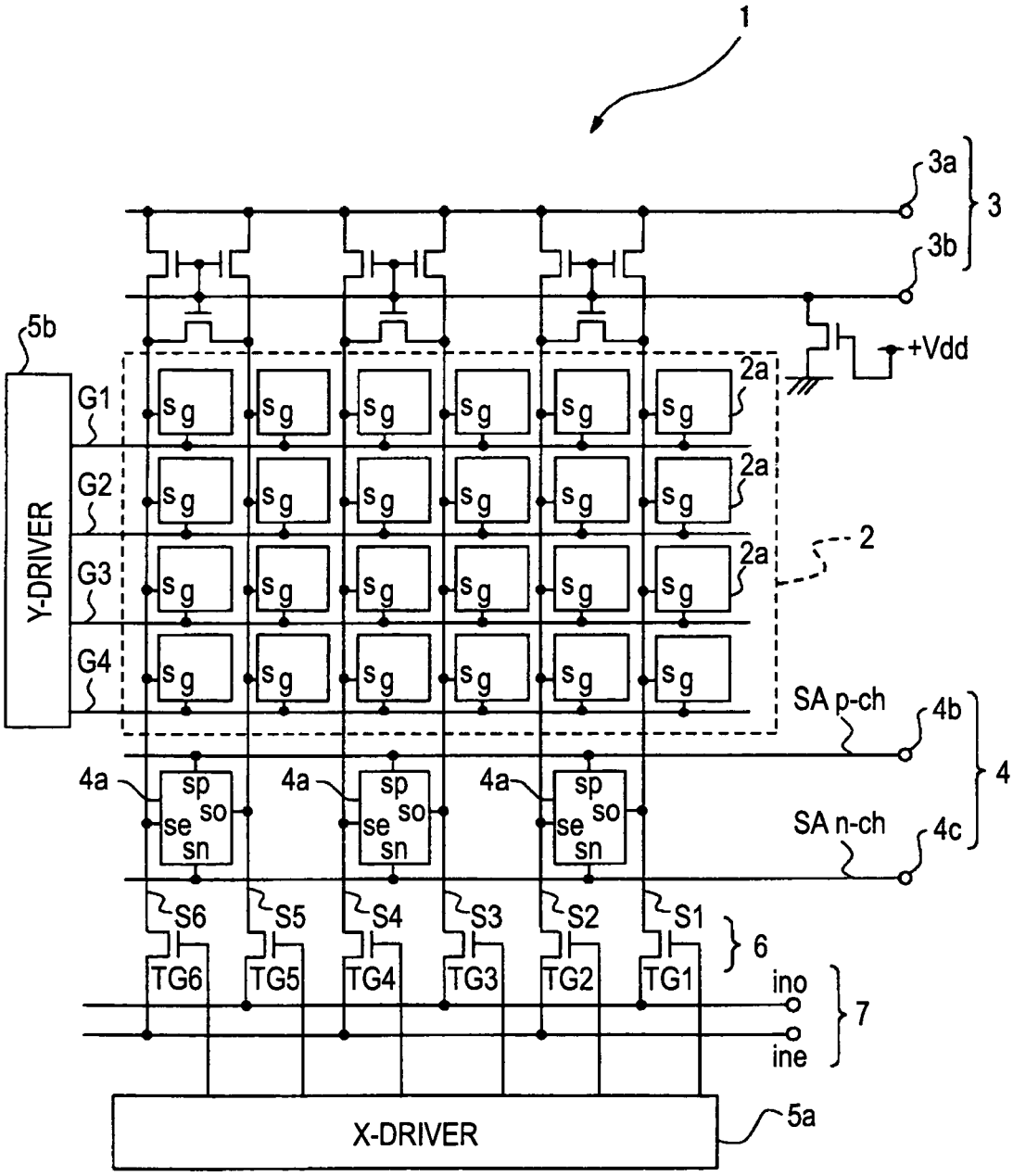
FIG. 1 is a circuit diagram of an element substrate of a liquid crystal display device which is a substrate for an electro-optical device having a test circuit.

FIG. 1 is a circuit diagram of an element substrate of a liquid crystal display device which is a substrate for an electro-optical device having such a test circuit. An element substrate 1 of the liquid crystal display device is a TFT substrate which is a substrate for an active-matrix-type display device. The element substrate 1 includes a display element array unit 2, a precharge circuit unit 3, and a display data reading circuit unit 4. The display element array unit 2 serving as a display unit has a plurality of pixels 2*a* of m rows×n columns that are two-dimensionally arranged in a matrix. In this case, m and n are integers. The element substrate 1 includes an X driver 5*a* and a Y driver 5*b* in order to drive the plurality of pixels 2*a* arranged in an X direction (a horizontal direction) and a Y direction (a vertical direction) of the display element array unit 2, a transmission gate unit 6, and image signal lines 7. The X driver 5*a*, the Y driver 5*b*, the transmission gate unit 6, and the image signal lines 7 constitute each of a data writing unit and a data reading unit. The transmission gate unit 6 supplies an image data signal input from the image signal line 7 in accordance with a timing signal output from the X driver 5*a*. The image signal line 7 has a signal line for supplying a signal to an odd column of the display element array unit 2 having the plurality of pixels arranged in a matrix and a signal line for supplying a signal to an even column of the display element array unit 2, which are respectively connected to corresponding nodes ino and ine.

The display element array unit 2 has a matrix structure composed of n columns including a first column, a second column, . . . , and an n-th column from the right side of FIG. 1 and m rows including a first row, a second row . . . , and an m-th row from the top side of FIG. 1. However, in order to simplify the description thereof, FIG. 1 illustrates an example of a circuit which is composed of pixels of four rows×six columns arranged in a matrix.

The precharge circuit unit 3 serves to apply a precharge voltage to each source line in order to test various characteristics, which will be described in detail below. In addition, various voltages may be selected as the precharge voltage. For example, the precharge voltage may be a power supply voltage Vdd, a grounding potential, or an intermediate potential between the power supply voltage Vdd and the grounding potential.

The display data reading circuit unit 4 has a plurality of differential amplifiers 4*a* provided such that one differential amplifier 4*a* is connected to a pair of source lines composed of an odd-column source line S (odd) and an even-column source line S (even) that are two-dimensionally arranged in a matrix. The display data reading circuit unit 4, which serves as a test circuit used at the time of performing the test, is formed on the element substrate of an active-matrix-driven liquid crystal display panel.

Figure 2:
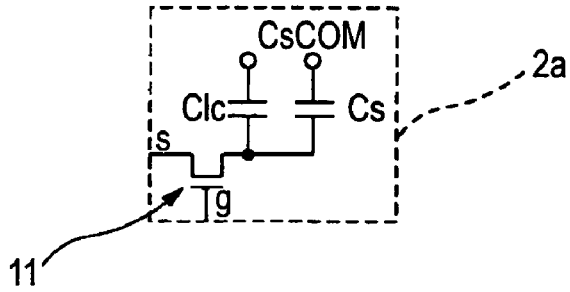
FIG. 2 is an equivalent circuit diagram of a pixel 2*a* of FIG. 1.

Next, the pixel 2*a*, which is a unit display element of the display element array unit 2, will be described. FIG. 2 is an equivalent circuit diagram of the pixel 2*a*.

Each pixel 2*a* includes a thin film transistor 11 (hereinafter, referred to as TFT) serving as a switching element, a pixel electrode, a common electrode, a liquid crystal capacitor Clc composed of liquid crystal, and an additional capacitor Cs connected in parallel to the liquid crystal capacitor Clc. One terminal of the liquid crystal capacitor Clc and one terminal of the additional capacitor Cs are connected to a drain terminal of the TFT 11. The other terminal of the additional capacitor Cs is connected to a common fixation potential CsCOM. A gate terminal g of the TFT 11 is connected to a scanning line G extending from the Y driver 5*b*. If a predetermined voltage signal is input to the gate terminal g of the TFT 11 and the TFT 11 is turned on, a voltage, which has been applied to a source terminal s of the TFT 11 connected to the source line S, is applied to the liquid crystal capacitor Clc and the additional capacitor Cs, so that a supplied predetermined potential is maintained.

Figure 3:
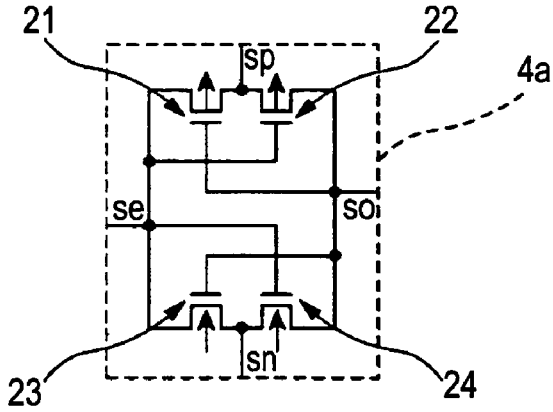
FIG. 3 is a circuit diagram specifically illustrating a differential amplifier 4*a* of a display data reading circuit unit 4.

FIG. 3 is a circuit diagram specifically illustrating the differential amplifier 4*a* of the display data reading circuit unit 4. The differential amplifiers 4*a* shown in FIG. 3 are provided as much as (n/2) with respect to n pixels (n is an integer and an even number) arranged in one direction of a two-dimensional matrix, that is, an X direction. Accordingly, (n/2) differential amplifiers 4*a* are connected to a plurality of corresponding source lines with respect to pixels of n columns.

Each of the differential amplifiers 4*a* includes two P-channel-type transistors 21 and 22, and two N-channel-type transistors 23 and 24. Gates of the transistors 21 and 23 are connected to the terminal so and gates of the transistors 22 and 24 are connected to the terminal se. Source/drain paths of the transistors 21 and 22 are connected in series to each other, and source/drain paths of the transistors 23 and 24 are also connected in series to each other. Between the nodes so and se, the source/drain paths of the transistors 21 and 22 and the sources/drain paths of the transistors 23 and 24 are connected in parallel to each other.

The node so is connected to each of source lines S1, S3, S5, . . . of odd-row pixels. In addition, the node se is connected to each of the source lines S2, S4, S6, . . . of even-row pixels. A node sp of the transistors 21 and 22 of each differential amplifier 4*a* is connected to a node 4*b* for supplying a first driving pulse power supply SAp-ch of the display data reading circuit unit 4. A node sn of the transistors 23 and 24 of each differential amplifier 4*a* is connected to a terminal 4*c* for supplying a second driving pulse power supply SAn-ch of the display data reading circuit unit 4.

In a case in which a high voltage is applied to one of an odd-column source line S (odd) and an even-column source line S (even) which are two source lines S connected to the nodes so and se and a low voltage is applied to the other, the differential amplifier 4*a,* which is a cross-linked amplifier serving as an amplifying unit, operates such that the voltage of the source line applied with the low voltage further decreases and the voltage of the source line applied with the high voltage further increases in accordance with a voltage difference generated between the two source lines of the odd-column source line S (odd) and the even-column line S (even).

In the differential amplifier 4*a* shown in FIG. 3, the node sp connected to the terminal 4*b* is a terminal to which a timing signal whose output level is a high level (hereinafter, simply referred to as HIGH) is input. In addition, the node sn connected to the terminal 4*c* is a terminal to which a timing signal whose output level is a low level (hereinafter, simply referred to as LOW) is input.

In the differential amplifier 4*a* constructed in this way, LOW is applied to the node sn and HIGH is applied to the node sp. In this case, if the node se has a slightly larger potential than the node so, the transistor 24 is first turned on. Since the transistor 24 is turned on, the potential of the node so falls to a low grounding potential of the terminal 4*c*. In addition, since the potential of the node so falls to the low grounding potential of the terminal 4*c,* the transistor 21 whose gate is connected to the node so is turned on. As a result, the potential of the node se rises to a high power supply voltage Vdd of the terminal 4*b*.

As such, the differential amplifier 4*a* serves to make the potential of the high-potential-side source line of the two adjacent source lines further increased and to make the potential of the low-potential-side source line further decreased.

In FIG. 1, only one differential amplifier 4*a* is provided with respect to the two adjacent source lines. This is performed in order that the differential amplifier 4*a* can easily be formed on the element substrate 1, and when an external noise occurs, the external noise affects both the source lines equally. One differential amplifier may be provided with respect to source lines of the pixels which are not adjacent to each other.

If the element substrate of the liquid crystal display device, which is the active-matrix-type display device having the above-mentioned structure, is manufactured according to the manufacturing process, it is possible to evaluate or test an electrical characteristic of the element substrate itself before bonding the element substrate to the counter substrate and inserting the liquid crystal between the element substrate and the counter substrate. Examples of defects that can become a test subject of the electrical characteristic may include a LOW fixation defect caused by the leakage of the data storage capacitor (additional capacitor Cs) of each pixel of the element substrate, a HIGH fixation defect caused by the leakage between the source and the drain of the TFT serving as the switching element, or the like.

Next, the test and operation of the substrate having the above-mentioned structure will be described. The operation when the liquid crystal display device, which is finished by bonding the TFT array substrate shown in FIG. 1 to the counter substrate and inserting the liquid crystal between the TFT array substrate and the counter substrate, performs general image display will be described before describing a method of testing the element substrate 1 in the manufacturing process.

First, in the two image signal lines 7, pixel data signals, which are pixel signals of the odd-column image signal line and the even-column image signal line, are input to the input terminals ine and ino of the image signal line 7. Each of the pixel data signals is supplied to each source line S through each transistor of the transmission gate unit 6 in accordance with a column selection signal from the X driver 5*a*.

The pixel signal supplied to each source line S is written in each pixel 2*a* of a row selected after the scanning line G extending from the Y driver 5*b* becomes HIGH. That is, in the selected scanning line G, the image data signal supplied to the source line S is supplied to the corresponding-pixels 2*a* as an image data signal for display and is then held therein. This operation is row-sequentially performed, so that a desired image is displayed on the display element array unit 2 of the liquid crystal display device.

The precharge circuit unit 3 is a circuit for applying a precharge voltage Vpre to each source line S before the scanning line G becomes HIGH. The precharge voltage Vpre is supplied to a terminal 3*a* of the precharge circuit unit 3. The timing for supplying the precharge voltage Vpre is determined according to the voltage applied to a precharge gate terminal 3*b*.

Therefore, when image display is performed in the liquid crystal display device serving as a product or a trial product, the display data reading circuit unit 4 of the element substrate 1 does not operate and is not used.

Next, a sequence of the test performed in the element substrate 1 after a circuit portion shown in FIG. 1 is manufactured by a process of manufacturing a semiconductor is described. At the time of testing the element substrate 1, the display data reading circuit unit 4 operates and is used.

Figure 4:
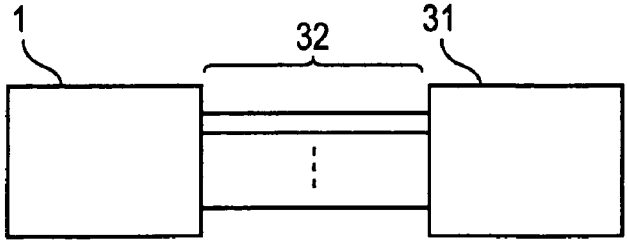
FIG. 4 is a diagram illustrating a structure of a test system.

First, a test system for implementing the test method will be described. FIG. 4 is a diagram illustrating a structure of the test system. The element substrate 1 is connected to a test device 31 in which pixel data can be written and can be read through a connection cable 32. The connection cable 32 serves to electrically connect to the test device 31 the terminals ino and ine of the image signal lines 7 of the element substrate 1, the terminals 4*b* and 4*c* of the signal lines of the display data reading circuit unit 4, the terminals 3*a* and 3*b* of the precharge circuit unit 3, or the like.

A predetermined voltage is supplied to each terminal in a predetermined order (which will be described in detail below), so that it is possible to test the electrical characteristic of the element substrate 1 through the test device 31. Hereinafter, a method of testing whether the LOW fixation defect and the HIGH fixation defect exist or not as test contents will be described.

Figure 5:
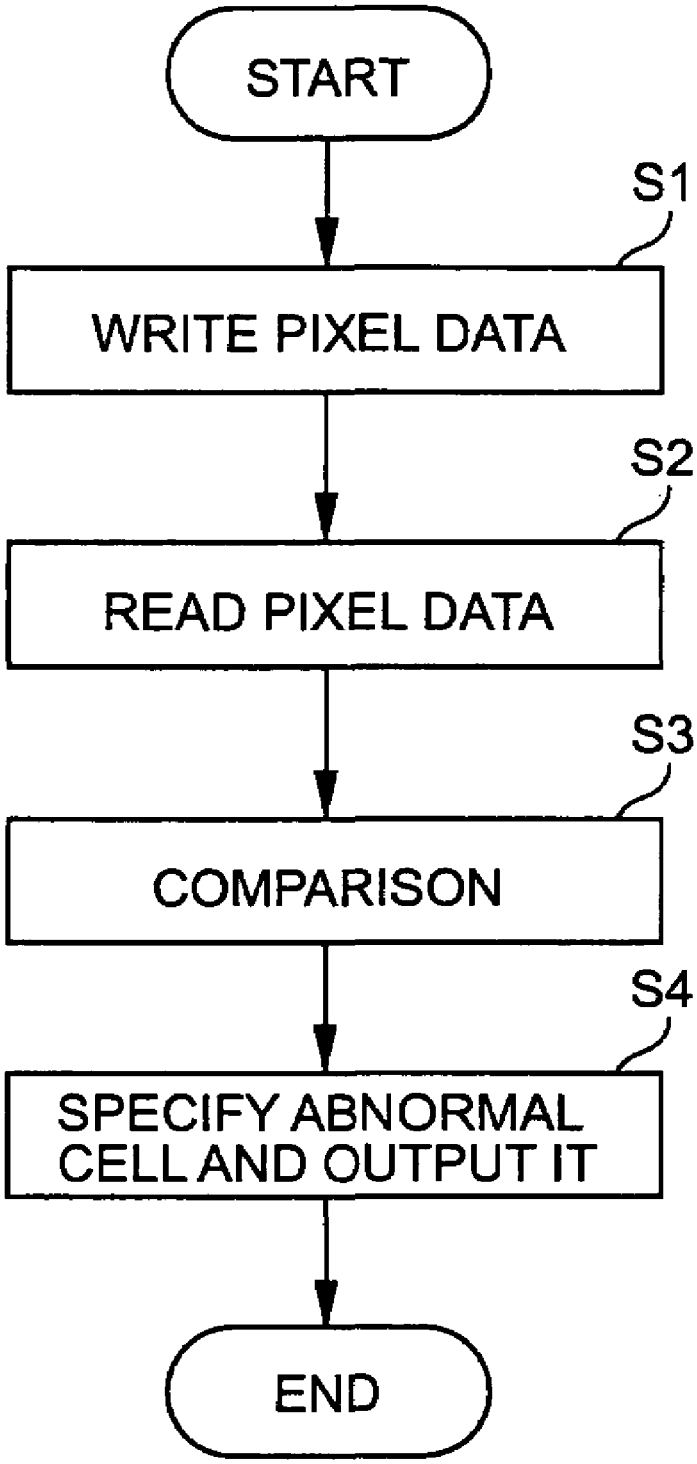
FIG. 5 is a flowchart illustrating an overall flow of the test.

First, the overall flow of the test will be described. FIG. 5 is a flowchart illustrating an example of the flow of the test.

An operation state of each differential amplifier 4*a* of the display data reading circuit unit 4 is set to a non-operating state. Specifically, each potential of the first driving pulse power supply SAp-ch and the second driving pulse power supply SAn-ch is set to an intermediate potential (Vdd/2)

between the power supply voltage Vdd and the grounding potential. In this state, from the input terminals ino and ine of the image signal lines 7, a predetermined pixel data signal is supplied to each pixel serving as a unit cell, that is, written in each pixel (step (hereinafter, simply referred to as S) 1). Specifically, HIGH is supplied to the odd-side source line S (odd) and LOW is supplied to the even-side source line S (even), so that HIGH is written in the odd-numbered pixels of the selected row and LOW is written in the even-numbered pixels of the selected row. This writing process is performed for every row, so that the pixel data signal is written in all pixels of all rows. FIG. 6A is a diagram illustrating a state of LOW (L) and HIGH (H) of the pixel data written in each of the pixels arranged in a matrix of four rows×six columns. As shown in FIG. 6A, in pixel data of the display element array unit 2, a column of LOW (L) and a column of HIGH (H) are alternately represented, so that they constitute a matrix.

Next, the written pixel data is read out from each row while operating the display data reading circuit unit 4 (S2). The operation of the display data reading circuit unit 4 will be described in detail below. As described below, when the display data reading circuit unit 4 operates, a first precharge period is allowed to be slightly lengthened. Thereby, in the data storage capacitor (Cs), a variation of a voltage due to a current leakage phenomenon is sure to appear. That is, when the display data reading circuit unit 4 reads the pixel data, it carries out an output process that amplifies the signal output on the signal line to output it.

In addition, the test device 31 compares the pixel data read during the reading process with the pixel data written during the writing process (S3). In this comparison process, it is determined whether the pixel data written in each pixel is equal to the pixel data read out from each pixel.

The test device 31 specifies a cell in which the written pixel data and the read pixel data are not equal to each other, that is, a pixel, and outputs it as an abnormal cell. Specifically, the test device 31 outputs data such as a cell number of the abnormal cell such that it is displayed on a screen of a monitor (not shown) (S4).

Figure 7:
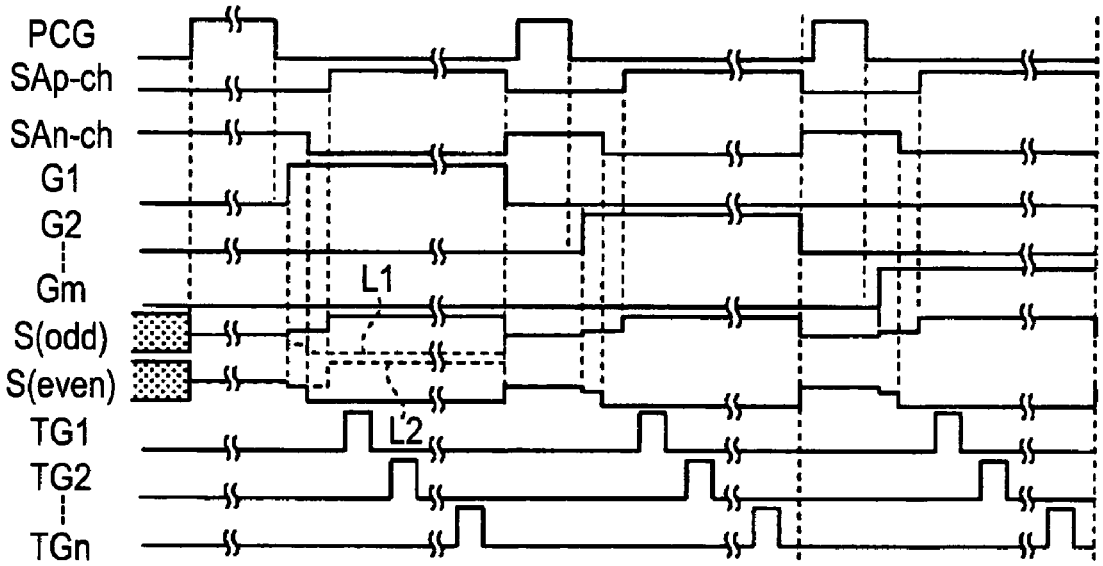
FIG. 7 is a timing chart illustrating the reading operation.

Next, the reading operation of the pixel data corresponding to S2 of FIG. 5 will be described using a timing chart of FIG. 7. FIG. 7 is a timing chart illustrating the reading operation in the circuit of FIG. 1. The test of the pixels is performed by determining whether a column to be a test subject is normal with respect to a reference column or not. First, the reference column is set to an even column and the column to be the test subject is set to an odd column. The timing signal shown in FIG. 7 is generated by the test device 31 and is then supplied to each terminal.

As shown in FIG. 6A, the pixels of the even column are set as the reference data writing pixels, and LOW is written in the pixels of the even column, and HIGH is written in the pixels of the odd column to be a test subject. Then, each pixel of the odd column to be a test subject is tested.

As shown in FIG. 7, after the predetermined pixel data is written with respect to all the pixels, a precharge gate voltage PCG, which is supplied to the terminal 3*b* of the precharge circuit unit 3, becomes HIGH, and the precharge is then performed. After the passage of a predetermined time in the precharge state, the reading operation starts. In addition, a precharge potential of each source line S (a voltage applied to a precharge voltage applying terminal 3*a*) Vpre is set to an intermediate potential between HIGH and LOW, and the CSCOM potential shown in FIG. 2 is set to (the LOW potential−ΔV). The reason why the CsCOM potential is set to (the LOW potential−ΔV) is as follows. In a case in which there is a leakage defect in the data storage capacitor Cs, since the CsCOM potential of the leakage point becomes (the LOW potential−ΔV), the reading potential is set so as to have a lower value than the reference potential. In addition, the first precharge period is set to a slightly long time, which makes a variation of a voltage due to the leakage defect appear.

In the reading operation of the first row, the precharge gate voltage PCG is set to LOW so as to stop the precharge and then the potential of the scanning line G1 is set to HIGH so as to turn on each of the TFTs 11 which are pixel transistors of the first row. The TFTs 11 of all pixels connected to the scanning line G1 are simultaneously turned on. As a result, an electric charge accumulated in the capacitor Cs moves to the source line S. A potential of the odd-side source line (S(odd)) where HIGH is written increases to a potential slightly higher than the intermediate potential, and a potential of the even-side source line (S(even)) serving as the reference-side source line decreases to a potential slightly lower than the intermediate potential. An SAn-ch driving pulse power supply is set to LOW and an SAp-ch driving pulse power supply is set to HIGH, so that the display data reading circuit unit 4 is driven.

However, in a case in which the leakage of the data storage capacitor Cs of the odd-side pixel is generated, as shown by a dotted line L1 in FIG. 7, the potential of the odd-side source line (S(odd)) decreases more than the potential of the even-side source line (S(even)). As a result, as shown by a dotted line L2, the potential of the even-side source line increases.

The SAn-ch driving pulse power supply becomes LOW, so that the potential slightly lower than the intermediate potential is changed to LOW. Subsequently, the SAp-ch driving pulse power supply becomes HIGH, so that potential slightly higher than the intermediate potential is changed to HIGH. This is because as described above, by the operation of each differential amplifier 4*a* of the display data reading circuit unit 4, two potential levels, which have a high value and a low value and appear on two source lines S, are changed to the voltages of the nodes sp and sn. This operation is simultaneously performed in all the pixels connected to the scanning line G1.

In addition, gates TG1 to TGn of the transistors of the transmission gate unit 6 are sequentially opened (HIGH), and the image data of each of the pixels corresponding to the first row is sequentially read out from the image signal lines 7.

After the final transmission gate TGn is opened, the precharge operation starts again. It is not necessary that the precharge operation time, that is, a precharge time after the second precharge time is long as much as the first precharge time.

Accordingly, as described above, the written pixel data and the read pixel data are compared with each other (S3). In a case in which a state of the odd-side pixel which becomes a test subject and in which the pixel data is written is changed from HIGH to LOW when the odd-side pixel is read out, it can be determined that the odd-side pixel is a LOW fixation defect. In the test device 31, this pixel having the LOW fixation defect, that is, the abnormal cell is output to a display device (not shown) (S4).

A potential of the second scanning line G2 is set to HIGH after the precharge operation is stopped, so that a TFT 11 of each of the pixels corresponding to the second row is turned on. Hereinafter, in the same manner, the pixel data is read out from the pixels connected to the final scanning line Gm, that is, pixels corresponding to the m-th row.

Each read pixel data and each written pixel data are compared with each other, so that it is possible to check whether there is the LOW fixation defect in each of pixels of the odd column to be the test subject.

Next, the relationship between the even column and the odd column is reversed. That is, the odd-side pixel is set to a reference data writing pixel, LOW is written in the odd-side pixel, HIGH is written in the even-side pixel to be the test subject, and the same process as that shown in FIG. 5 is performed. Thereby, it is tested with respect to the odd-side pixel as a reference side whether there is the LOW fixation defect in the even-side pixel.

As described above, using one of the odd column and the even column as a reference, the test determining whether there is the LOW fixation defect in the pixel of the other is performed with respect to both the odd column and the even column, so that it can be tested with respect to all the pixels whether the LOW fixation defect exists or not.

Figure 8:
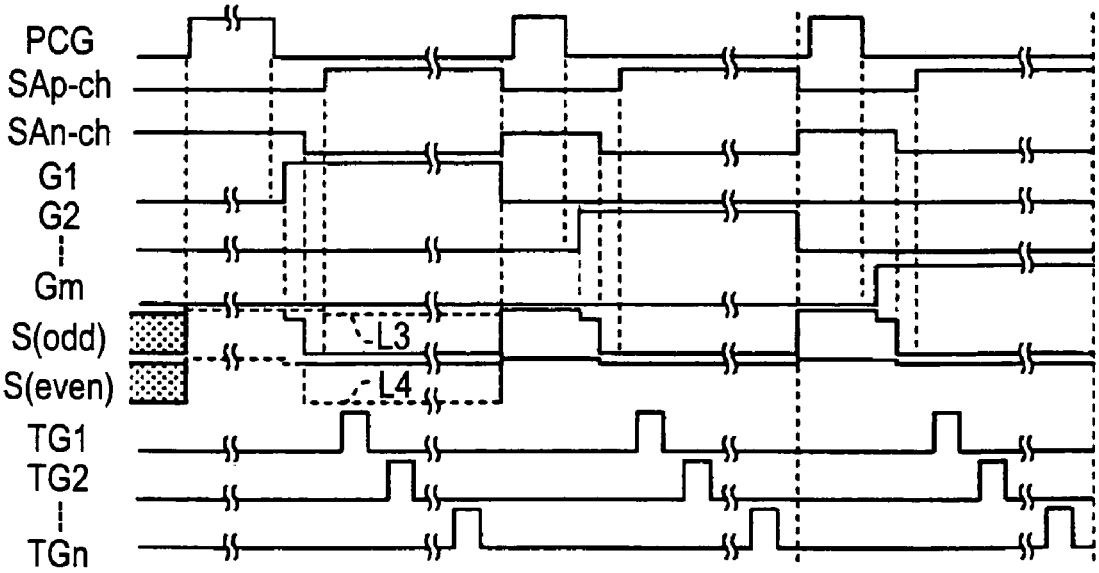
FIG. 8 is a timing chart illustrating a test determining whether a HIGH fixation defect exists.

Next, a test for determining whether a HIGH fixation defect exists or not will be described with reference to FIG. 8. FIG. 8. is a timing chart illustrating the reading operation in the test for determining whether the HIGH fixation defect exists or not.

In the same manner as in the case of the above-mentioned LOW fixation defect, first, the even-side pixel is set to the reference data writing pixel. However, at the time of writing the pixel data, HIGH is written in the even-side pixel and LOW is written in the odd-side pixel to be the test subject.

As shown in FIG. 6B, the pixel data (pixel data in a state in which the relationship between H and L shown in FIG. 6A is reversed) is written with respect to all the pixels. Then, after the passage of a predetermined time in the precharge state, the reading operation starts. At this time, a precharge potential of each source line S (a voltage applied to a precharge voltage applying terminal 3*a*) Vpre is set to (the HIGH potential+ΔV). The reason why the precharge potential Vpre is set to (the HIGH potential+ΔV) is as follows. In a case in which there is a leakage between the source and the drain of the TFT 11, since the potential of the source line S of the leakage point is (the HIGH potential+ΔV), the reading potential is set to have a higher value than the reference potential.

In the reading operation, the precharge is stopped, and the potential of the scanning line G1 is then set to HIGH so as to turn on each of the transistors TFTs 11. The TFTs 11 of all pixels of the first row connected to the scanning line G1 are simultaneously turned on. A potential of the even-side source line S(even) of the reference side where HIGH is written decreases slightly from the precharge potential Vpre (changed to the HIGH potential), and a potential of the odd-side source line S(odd) where LOW is written decreases further from the precharge potential Vpre. Accordingly, the differential amplifier 4*a* further decreases the potential of the odd-side source line S(odd) where LOW is written and maintains the potential of the even-side source line S(even) where HIGH is written as the HIGH potential.

However, in a case in which the leakage is generated between the source and the drain of the TFT 11 of the odd-side pixel to be the test subject, a potential of the capacitor Cs of the pixel of the leakage point becomes the precharge potential (the HIGH potential+ΔV), so that it becomes higher than the potential of the pixel of the even side serving as a reference side. Accordingly, at the time of reading the pixel data, as shown by a dotted line L3 of FIG. 8, the potential of the odd-side source line S (odd) is little changed while maintaining the precharge potential (the HIGH potential+ΔV). That is, the potential of the odd-side source line S (odd) becomes higher than the potential of the even-side source line S (even). The SAn-ch driving pulse power supply becomes LOW, so that the potential lower than the intermediate potential is changed to LOW. Subsequently, the SAp-ch driving pulse power supply becomes HIGH, so that potential higher than the intermediate potential is changed to HIGH. As a result, as shown by a dotted line L4, the potential of the even-side source line S (even) becomes LOW and the potential of the odd-side source line S (odd) becomes HIGH.

Accordingly, since the written pixel data and the read pixel data are different from each other in the pixel cell to be the test subject, it is possible to detect the abnormal cell.

Hereinafter, the operation of the differential amplifier is the same as that at the time of detecting the above-mentioned LOW fixation defect. By performing the above-mentioned operation in a state in which the reference side is set as the odd side and the test subject is set as the even side, it can be tested with respect to all the pixels whether there is the HIGH fixation defect.

As described above, in a state in which the reference side is changed from the even side to the odd side, it is tested whether there is the LOW fixation defect and it is tested whether there is the HIGH fixation defect. Thereby, it can be tested with respect to all the pixels whether there is the LOW fixation defect and the HIGH fixation defect.

In addition, in the above-mentioned example, HIGH or LOW is written in the pixel of the reference side and the test is performed. However, the signal having the intermediate potential may be written in the pixel of the reference side.

A method of performing a test in a state in which an intermediate potential between HIGH and LOW is written in the pixel of the reference side will be described with reference to FIG. 9.

In the same manner as a case of detecting the above-mentioned LOW fixation defect, first, the even-side pixel is set to the reference data writing pixel, an intermediate potential between HIGH and LOW is written in the even-side pixel, and HIGH or LOW is written in the odd-side pixel to be the test subject. As shown in FIG. 10, first, HIGH is written in the odd-side pixel and an intermediate potential (M) between HIGH and LOW is written in the even-side pixel.

The predetermined pixel data is written with respect to all the pixels. Then, after the passage of a predetermined time in the precharge state, the reading operation starts. At this time, a precharge potential of each source line S (a voltage applied to a precharge voltage applying terminal 3*a*) Vpre is set to an intermediate potential between HIGH and LOW.

In the reading operation, first, the precharge is stopped, and the potential of the scanning line G1 is set to HIGH to turn on each of the TFTs 11. The TFTs 11 of all pixels connected to the scanning line G1 are simultaneously turned on. The potential of the source line of the even side serving as the reference side is not changed while maintaining the intermediate potential of the precharge potential. Since HIGH is written, the potential of the odd-side source line S increases to a potential slightly higher than the intermediate potential. Accordingly, by means of the differential amplifier 4*a,* the even side becomes LOW and the odd side becomes HIGH, so that the pixel data written in the odd side is not changed while maintaining HIGH.

However, in a case in which the leakage is generated in the data storage capacitor Cs of the pixel to be the test subject, the potential of the odd-side source line S(odd) decreases to the potential slightly lower than the intermediate potential. Accordingly, by means of the differential amplifier 4*a*, the odd side becomes LOW, as shown by a dotted line L5 of FIG. 9, and the even side becomes HIGH, as shown by a dotted line L6. As a result, the pixel data written in the odd side becomes LOW without becoming HIGH.

Hereinafter, the operation of the differential amplifier is the same as that at the time of detecting the above-mentioned LOW fixation defect. In the same manner, the pixel data is read out from all the rows.

Figures 9, 10:
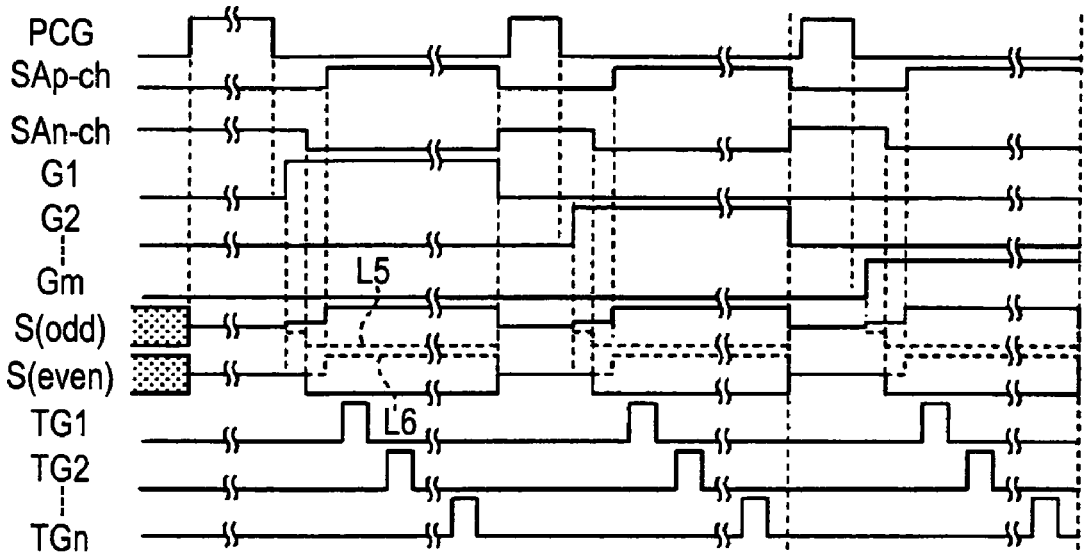
FIG. 9 is a timing chart illustrating a test performed by writing an intermediate potential between a HIGH potential and a LOW potential in a reference-side pixel.
FIG. 10 is a diagram illustrating a test method.

Next, LOW is written in the odd side (a state in which H of FIG. 10 is changed to L) and the intermediate potential is written in the even side serving as the reference side. In addition, the same operation as that when the pixel data is read out while HIGH is written in the above-mentioned odd side is row-sequentially performed with respect to all the pixels.

As a result, the test device 31 can obtain data obtained by reading the pixel data in a case in which the intermediate potential is written in the reference side and the pixel data in a case in which HIGH and LOW are written in the test subject side. The pixel data in which HIGH and LOW are written is compared with the read pixel data in each of the cases. At this time, even in any one of a case of writing LOW in any pixel and a case of writing HIGH in any pixel, when LOW is read out, it is first considered whether there is the leakage defect in the capacitor Cs of the corresponding pixel. Further, the potential of the source line to be the test subject becomes the precharge potential due to the capacitance and the high resistance of the TFT, or the leakage between the source and drain of the TFT, that is, the reading and amplifying operation becomes the potential comparison subject between the precharge potentials. Therefore, it can be determined that the test subject side may always become LOW due to the unique characteristic of the circuit.

In addition, in any case, when HIGH is read, the same disadvantage as in the case of LOW may occur due to the possibility that the leakage defect may occur in the capacitor Cs. That is, the intermediate potential is written in the reference side and LOW and HIGH are written in the test subject side (any one of LOW and HIGH may be first written). The pixel data of the individual cases is read out and is then compared with each other, so that it is possible to detect the defect of the capacitor Cs and the TFT in the cell.

Next, if the same test is performed in a state in which the odd column is set to the reference side and the even column is set to the test subject side, it can be tested with respect to all the pixels whether there is the defect in the capacitor Cs and the TFT.

As described above, according to the operation illustrated in FIG. 9, in a case in which the data having written HIGH and LOW is fixed to LOW or HIGH when it is read out, it can be determined that there is a defect in the capacitor Cs or the TFT.

Figure 11:
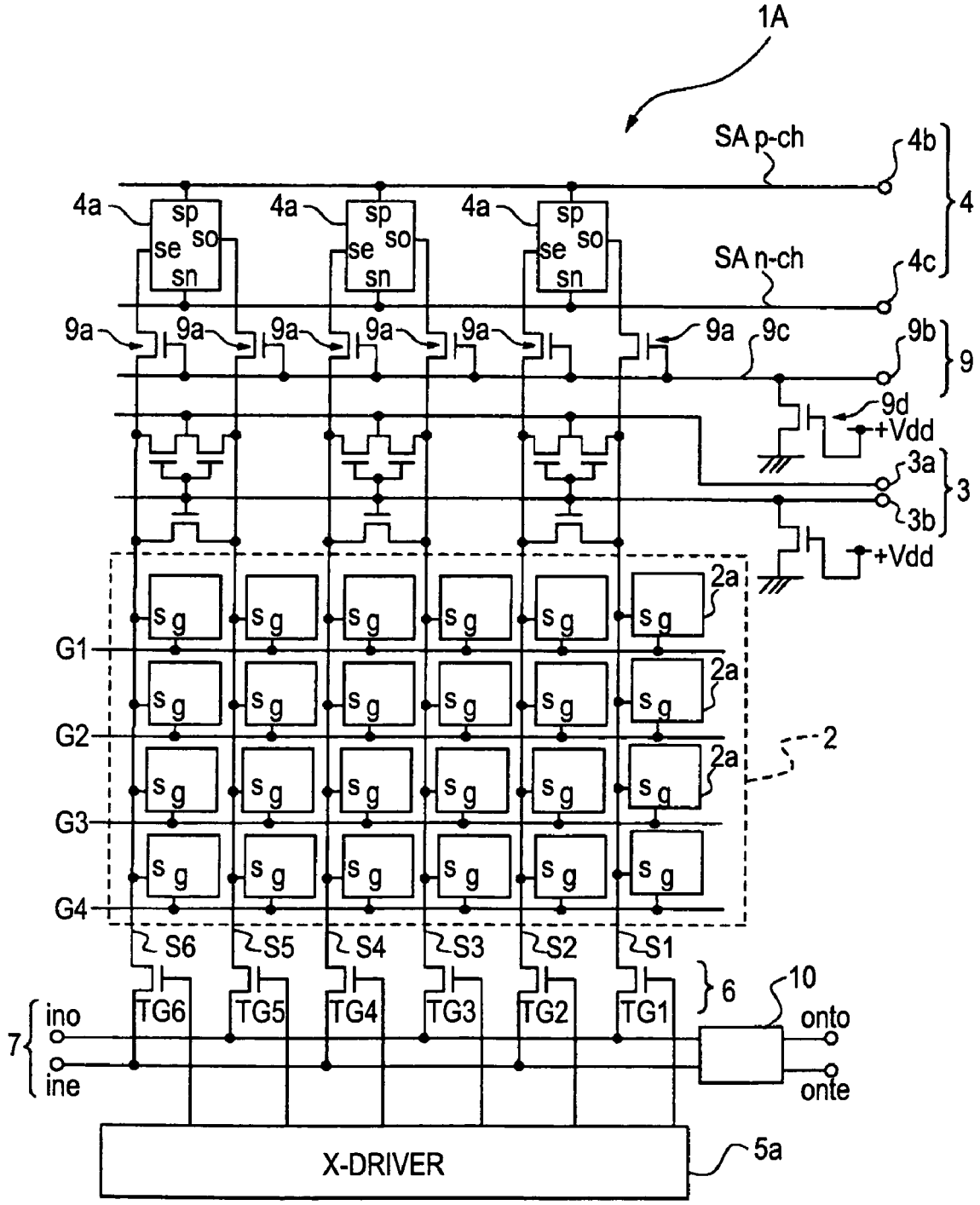
FIG. 11 is a circuit diagram illustrating a modifcation of a circuit of an element substrate shown in FIG. 1.

FIG. 11 is a circuit diagram illustrating a modification of the element substrate shown in FIG. 1. In FIG. 1, the display data reading circuit unit 4 of the element substrate 1A is provided between the source lines S from the precharge circuit unit 3 and the transmission gate unit 6. In FIG. 11, the display data reading circuit unit 4 is connected to the source lines S from the precharge circuit unit 3 through the connection gate unit 9.

According to the structure illustrated in FIG. 11, the gate terminal of each transistor 9*a* of the connection gate unit 9 is connected to the connection gate terminal 9*b* through the signal line 9*c*. In general, since the gate terminal of the transistor 9*d* becomes HIGH, the potential of the connection gate terminal 9*b* is controlled such that the signal line 9*c* becomes LOW, and the display data reading circuit unit 4 is separated from the source lines. Accordingly, according to the structure of FIG. 11, when the display data reading circuit unit 4 is not used, it is completely separated from the source lines, so that there is an advantage in that it is not affected by an unstable operation state of the differential amplifier 4*a*.

When the above-mentioned reading operation is performed, the potential of the connection gate terminal 9*b* is controlled such that the signal line 9*c* becomes HIGH, so that it is possible to operate the display data reading circuit unit 4.

In addition, a differential amplifier 10 including a current mirror amplifier is provided with respect to the image signal lines 7. This is to prevent a difference between a HIGH signal and a LOW signal from decreasing due to a capacitance component which the image signal line 7 itself has. The HIGH signal and the LOW signal further become obvious, so that output signals outo and oute can be output at a high speed with high precision.

In addition, the display data reading circuit unit is provided with respect to all the pixels of the display element array unit. However, the display data reading circuit unit may be provided with respect to only some pixels used as the display unit without being provided with respect to all the pixels.

As described above, since the defect of the element substrate can be detected after the process of the element substrate is completed in the product or the trial product, a period for which a yield is lowered is shortened and the number of the defective products assembled is reduced, which results in a decrease of a cost. In particular, in the case of the trial product, the reduction of the development period and the development cost can be achieved.

Further, since the defect can be detected at the step of manufacturing the element substrate, it is possible to easily repair the defective product.

Furthermore, since an electric charge of the capacitor which is analog information is converted into digital information (voltage logic) by the display data reading circuit unit, detection sensitivity is high at the time of performing the test.

In addition, in the above-mentioned example, each differential amplifier is connected to twp adjacent source lines, so that the influence of the external noise is reduced. However, each differential amplifier may be provided such that it is connected to the source lines which are not adjacent to each other. If so, it is possible to remove an influence by the leakage between the adjacent source lines.

SECOND EXAMPLE OF SUBSTRATE

Next, a second example of the substrate to which the first embodiment is applied will be described.

Figure 12:
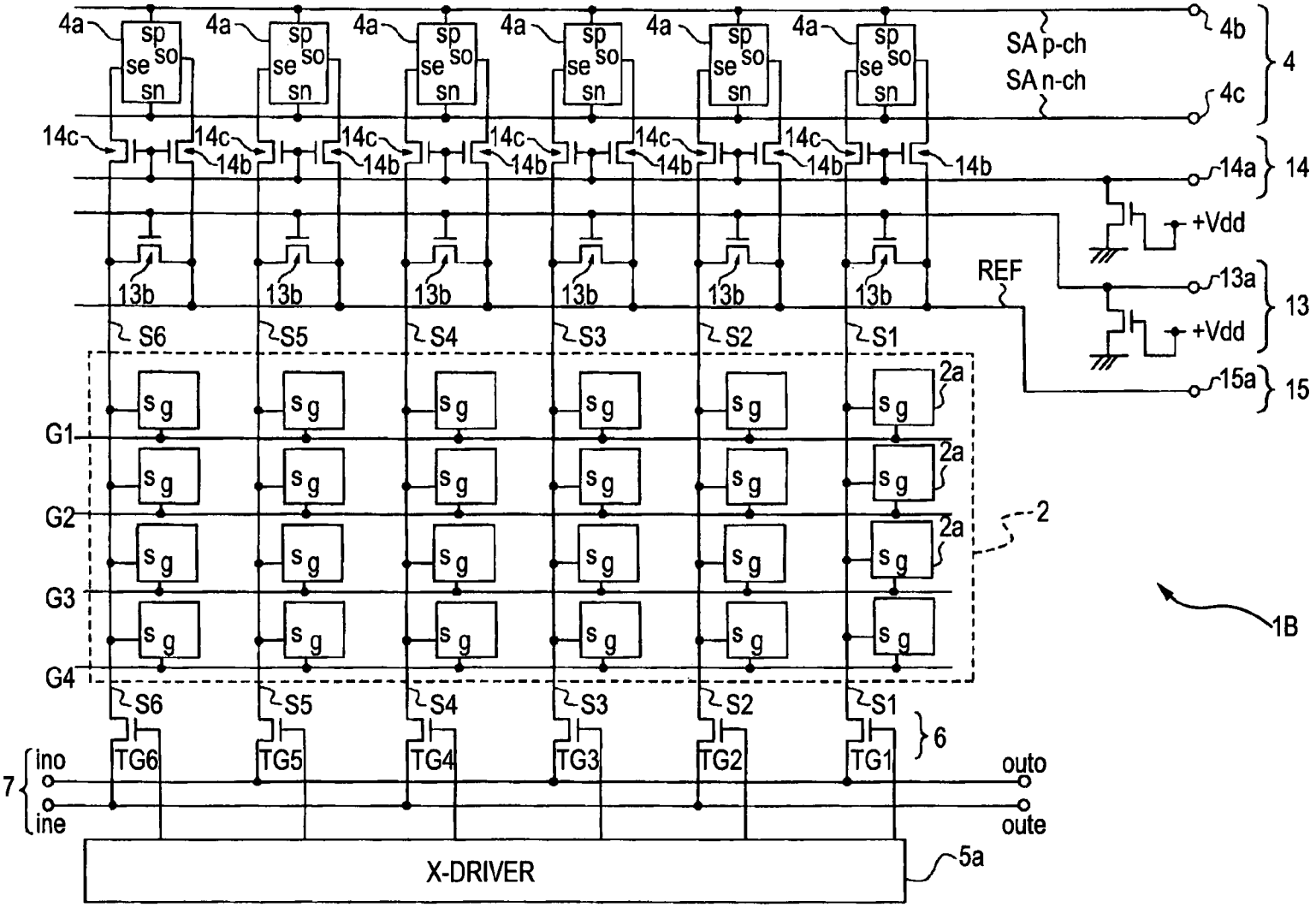
FIG. 12 is a circuit diagram of an element substrate of a liquid crystal display device which is a substrate for an electro-optical device having a test circuit.

FIG. 12 is a circuit diagram of an element substrate of a liquid crystal display device which is a substrate for an electro-optical device having the test circuit. In FIG. 12, the same constituent elements as FIG. 1 or FIG. 11 will be denoted by the same reference numerals, and the description thereof will be omitted.

An element substrate 1B of FIG. 12 includes a display element array unit 2, a display data reading circuit unit 4, an X driver 5*a*, a Y driver 5*b* (not shown in FIG. 12), a transmission gate unit 6, image signal lines 7, and differential amplifiers 4*a*. Further, the element substrate 1B includes a precharge circuit unit 13, a connection gate unit 14, and a reference voltage supply unit 15.

The precharge circuit unit 13 has a transistor 13*b* connected to each column, that is, each source line. A drain of each transistor 13*b* is connected to a node se of each differential amplifier 4*a* through a source line S, and a source of each transistor 13*b* is connected to a node so through a reference voltage supply line REF. In addition, a gate of each transistor 13*b* is connected to a gate terminal 13*a* for precharge.

As shown in FIG. 12, in the connection gate unit 14, one node so of each differential amplifier 4*a* is connected to the terminal 15*a* of the reference voltage supply unit 15 through one transistor 14*b* of the connection gate unit 14 and the reference voltage supply line REF. The terminal 15*a* is supplied with a reference voltage Vref. The other node se of each differential amplifier 4*a* is connected to the source line S through the other transistor 14*c* of the connection gate unit 14. Gates of the transistors 14*b* and 14*c* are connected to the gate terminal 14*a* for test circuit connection. The gate terminal 14*a* is supplied with a test circuit connection signal TE, which will be described in detail below.

The reference voltage supply line REF connected to the terminal 15*a* of the reference voltage supply unit 15 is connected to the source line S through a path between the source and the drain of the transistor for precharge 13*b*. Accordingly, by controlling the gate voltage of the transistor 13*b*, the transistor 13*b* is turned on, so that each source line S can be applied with the reference voltage Vref through the transistor 13*b*.

Figure 13:
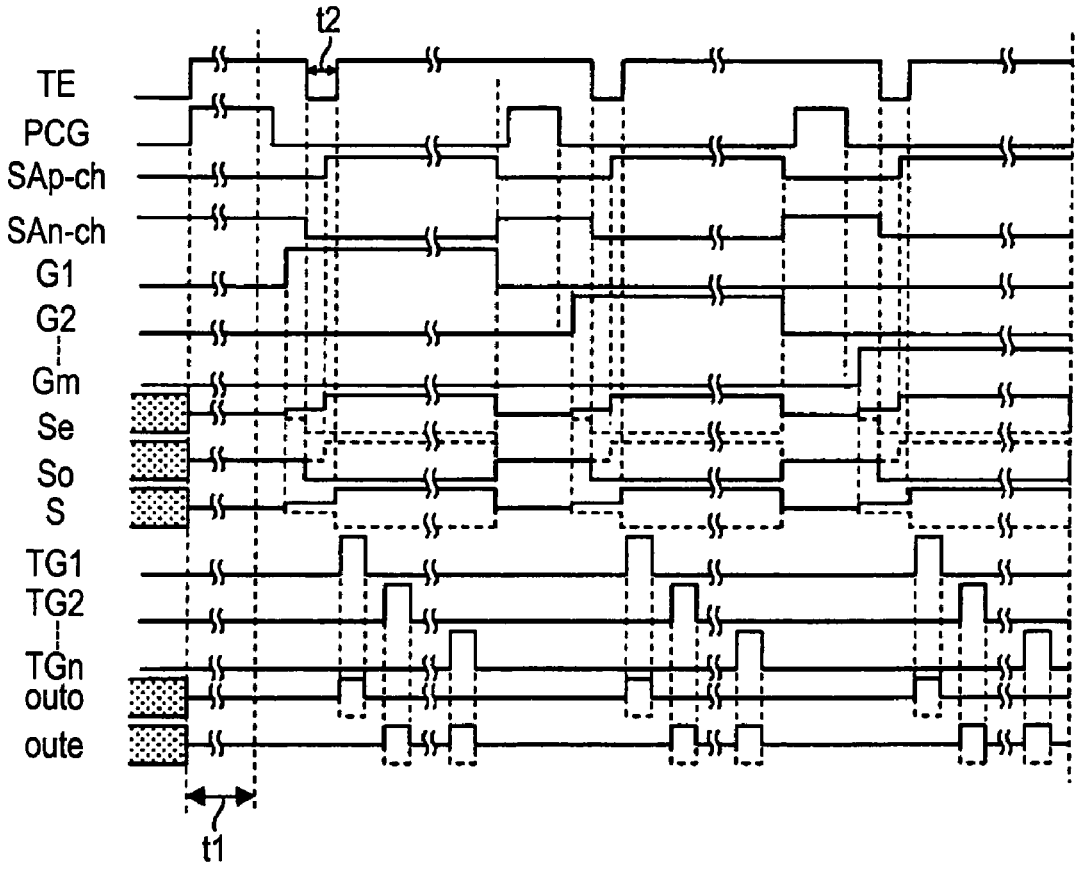
FIG. 13 a timing chart illustrating the reading operation of pixel data.

Next, the reading operation of the pixel data corresponding to S2 of FIG. 5 will be described using a timing chart of FIG. 13. FIG. 13 is a timing chart illustrating the reading operation in the circuit shown in FIG. 12. The pixel test is performed by determining whether each column is in a normal state or not. The timing signal illustrated in FIG. 13 is generated by the test device 31 shown in FIG. 4 and is then supplied to each terminal.

First, all scanning lines G of the element array unit 2 enter an on state, so that HIGH is written in all the pixels. Here, a case will be described in which HIGH is written in each pixel. However, LOW may be written in each pixel. Hereinafter, an example will be described in which the substrate 1B where HIGH is written in all the pixels is tested. However, the test may be performed with respect to only some pixels. After the writing process, the gate of the scanning line G enters an off state.

As shown in FIG. 13, in order to obtain a data holding time t1 after writing the above-mentioned predetermined pixel data (in this case, HIGH) in all the pixels, a precharge gate voltage PCG supplied to the terminal 13*a* of the precharge circuit unit 13 becomes HIGH, and the transistor 13*b* is turned on for a predetermined time. Further, a test circuit connection signal TE of the test circuit connecting gate terminal 14*a* also becomes HIGH. After the passage of the data holding time t1, the pixel data reading starts.

In addition, the transistor 13*b* is turned on for a predetermined time, so that the reference voltage Vref appears on both each source line S and the reference voltage supply line REF. Accordingly, if the gate line G enters an off state, it does not necessarily enter a precharge state. That is, each source line S and the reference voltage supply line REF may be equalized with the same potential. Furthermore, when the transistor 13*b* is turned on, the test circuit connection signal TE of the test circuit connecting gate terminal 14*a* may be not yet HIGH. Therefore, when the precharge gate voltage PCG is LOW after the passage of the data holding time t1, it is shifted from LOW to HIGH, and the precharge is performed.

From the reference voltage supply unit 15, the terminal 15*a* is applied with a precharge voltage (reference voltage Vref) of an intermediate potential between HIGH and LOW which is a precharge potential. Therefore, after the predetermined pixel data is written, the source line S and the nodes se and so enter an intermediate potential state.

In addition, in order to release the precharge state after the passage of the data holding time t1, the precharge gate voltage PCG becomes LOW. However, at this time, the test circuit connection signal TE becomes HIGH, and the potentials of the first driving pulse power supply SAp-ch and the second driving pulse power supply SAn-ch become an intermediate potential, which results in a state in which each differential amplifier 4*a* is not operated.

Further, the supply of the precharge gate voltage to the terminal 15*a* is stopped until the differential amplifier 4*a* starts the operation after the precharge gate voltage PCG becomes LOW.

If the gate line G1 enters an on state right after the precharge gate voltage PCG becomes LOW, the data is simultaneously output from the individual pixels which are connected to the gate line G1. Specifically, the electric charge, which is written and held in the capacitor Cs, simultaneously moves to the corresponding source line S. As shown in FIG. 13, the potential of the each source line S slightly increases. If the leakage of the capacitor Cs occurs and the data of each pixel is changed to LOW, the potential of each source line S slightly decreases, as shown by a dotted line.

In order to operate each differential amplifier 4*a* after the gate line G1 is activated and then the predetermined time passes, first, the potential of the second driving pulse power supply SAn-ch is changed from the intermediate potential to LOW. At the same time as the time when the potential of the second driving pulse power supply SAn-ch is changed from the intermediate potential to LOW or before and after it, the test circuit connection signal TE is set to LOW, and the transistors 14*b* and 14*c* of the connection gate unit 14 are turned off for a predetermined period t2. As a result, information of the slightly increased source line potential is confined in the differential amplifier 4*a*.

That is, the transistors 14*b* and 14*c* are turned off such that they do not affect the potentials of the nodes so and se of the differential amplifier 4*a* until the potentials of the nodes se and so of the differential amplifier 4*a* are fixed to LOW or HIGH. After the potentials of the nodes so and se of the differential amplifier 4*a* are fixed to LOW or HIGH, the transistors 14*b* and 14*c* are turned on in order to output the potentials of the nodes.

The SAn-ch driving pulse power supply becomes LOW, so that the potential slightly lower than the intermediate potential is changed to LOW. Each differential amplifier 4*a* compares the reference voltage Vref as an intermediate potential applied from the outside with a voltage of each source line S. If the pixel is normal, the potential of the source line S is slightly higher than the intermediate potential, the node so of each differential amplifier 4*a* has a lower potential than the node se. For this reason, as shown in FIG. 13, the potential of the node so decreases. At this time, the potential of the node se is held as it is.

Next, the SAp-ch driving pulse power supply becomes HIGH, so that P-channel-type transistors 21 and 22 of the differential amplifier 4*a* are operated. That is, the SAp-ch driving pulse power supply becomes HIGH, so that the potential slightly higher than the intermediate potential is changed to HIGH. If the pixel is normal, since the potential of the source line S is slightly higher than the intermediate potential, the node se of each differential amplifier 4*a* has a larger potential than the node so. For this reason, as shown in FIG. 13, the potential of the node se increases.

If there is a defect in the pixel, for example, if the leakage of the capacitor Cs is generated and the data of each pixel is changed to LOW, the potential of each source line S slightly decreases, as shown by a dotted line in FIG. 13. In this case, if the SAn-ch driving pulse power supply becomes LOW, the potential of the node se decreases, as shown by a dotted line in FIG. 13. In addition, if the SAp-ch driving pulse power supply becomes HIGH, the potential of the node so increases, as shown by a dotted line in FIG. 13.

In this case, since the test circuit connection signal TE enters an off state, the source line S becoming the load is not affected by the capacitance, so that the high operation can be achieved. In addition, since the reference voltage Vref is not a writing potential, a defect of any pixel is detected as a defect of the corresponding pixel, and the detailed defect characteristic classification can be achieved.

If logic in the nodes se and so of the differential amplifier 4*a* is fixed to any one of HIGH and LOW, the test circuit connection signal TE is set to HIGH, and the fixed logic data is rewritten on the source line S. The potential of each pixel connected to the gate line G1 is read out to the corresponding source line S, gates TG1 to TGn of the transistors of the transmission gate unit 6 are sequentially opened (HIGH), the pixel data of the individual pixels of the first row is sequentially read out from the image signal lines 7, and is then output to the output terminals outo and oute.

If the data of all pixels connected to the scanning line G1 is read out, the gate line G1 is set to LOW, and the SAn-ch driving pulse power supply and the SAp-ch driving pulse power supply are set to the intermediate potential, so that the operation of the differential amplifier 4*a* is stopped. Next, the precharge gate voltage PCG is set to HIGH, so that all the source lines S are precharged.

Hereinafter, the above-mentioned operation is repeated with respect to each line of the gate lines G2 to Gm, and the test of the pixels on the substrate is sequentially performed.

If the operation of the test, which is performed by writing the data of HIGH in all the pixels, is completed, the data of LOW is written in all the pixels, the same test is performed, and the operation of the test, which is performed by writing the data of LOW in all the pixels, is completed. Accordingly, since the test is performed only twice with respect to all the pixels, the test time is shortened, as compared with the device of FIG. 1.

As described above, also in the device of FIG. 12, it can be tested whether there is a defect in each pixel to be the test subject.

THIRD EXAMPLE OF SUBSTRATE

Next, a third example of the substrate to which the first embodiment is applied will be described.

Figure 14:
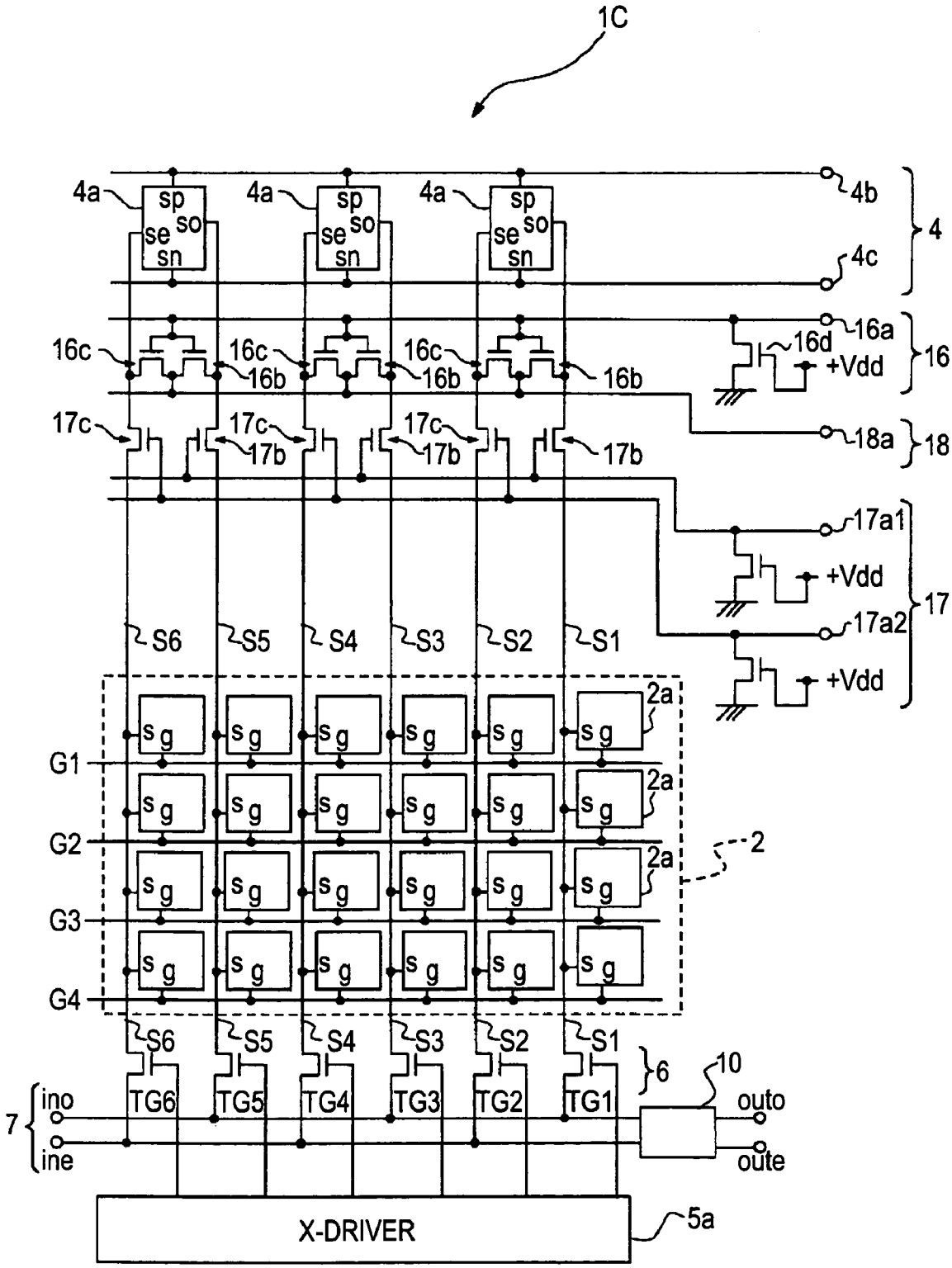
FIG. 14 is a circuit diagram of an element substrate of a liquid crystal display device which is a substrate for an electro-optical device having a test circuit.

FIG. 14 is a circuit diagram of an element substrate of a liquid crystal display device which is a substrate for an electro-optical device having the test circuit. In FIG. 14, the same constituent elements as FIG. 1 or FIG. 11 will be denoted by the same reference numerals, and the description thereof will be omitted.

An element substrate 1C shown in FIG. 14 includes a display element array unit 2, a display data reading circuit unit 4, an X driver 5*a*, a Y driver 5*b* (not shown in FIG. 14), a transmission gate unit 6, image signal lines 7, and differential amplifiers 10. Further, the element substrate 1C includes a precharge circuit unit 16, a connection gate unit 17, and a reference voltage supply unit 18.

The precharge circuit unit 16 has a pair of transistors 16*b* and 16*c* with respect to a pair of source lines composed of an odd-column source line S (odd) and an even-column source line S (even). The transistors 16*b* and 16*c* are connected in series to each other through the sources and the drains. The source of the transistor 16*b* is connected to a node so of each differential amplifier 4*a* through the odd-column source line S (odd). In addition, the drain of the transistor 16*c* is connected to a node se of each differential amplifier 4*a* through the even-column source line S (even). In addition, the gates of the transistors 16*b* and 16*c* are connected to a gate terminal 16*a* for precharge. In addition, the gate terminal 16*a* is connected to a pull-down circuit 16*d*. In FIG. 14, the pull-down circuit 16*d* is composed of a transistor which has a source connected to the gate terminal 16*a*, a drain connected to a reference potential point, and a gate applied with a power supply Vdd. A connection point between the transistors 16*b* and 16*c* is connected to a terminal 18*a* of the reference voltage supply unit 18. The terminal 18*a* is supplied with a reference voltage Vref. Accordingly, the gate voltages of the transistors 16*b* and 16*c* are controlled, so that the transistors 16*b* and 16*c* are simultaneously turned on. As a result, a reference voltage Vref supplied from the outside can be applied to each source line S through the transistors 16*b* and 16*c*. The reference voltage Vref is a voltage of an intermediate potential between HIGH and LOW.

As shown in FIG. 14, for the connection gate unit 17, one node so of each differential amplifier 4*a* is connected to an odd-column source line S (odd) through one transistor 17*b* of the connection gate unit 17. The other node se of each differential amplifier 4*a* is connected to the even-column source line S (even) through the other transistor 17*c* of the connection gate unit 17. The gate of the transistor 17*b* is connected to the odd-column test circuit connecting gate terminal 17*a*1, and the gate of the transistor 17*c* is connected to the even-column test circuit connecting gate terminal 17*a*2. The gate terminals 17*a*1 and 17*a*2 are respectively supplied with test circuit connection signals TEo and TEe, which will be described in detail below.

Accordingly, any one of the test circuit connection signals TEo and TEe is set to HIGH, so that only the data of any one of the pixel of the odd-column source line S (odd) and the pixel of the even-column source line S (even) can be read out by one differential amplifier 4*a*. The read potential appearing on the source line S (minute potential change) is transmitted to the differential amplifier 4*a* through any one of the transistors 17*b* and 17*c*. After the potential allows the transistor which is turned on and is then opened to be temporarily closed, it is amplified in the differential amplifier 4*a*. After that, the potential allows the temporarily closed transistor to be opened again, is then rewritten on the source line, and is then output through the image signal line 7.

Figure 15:
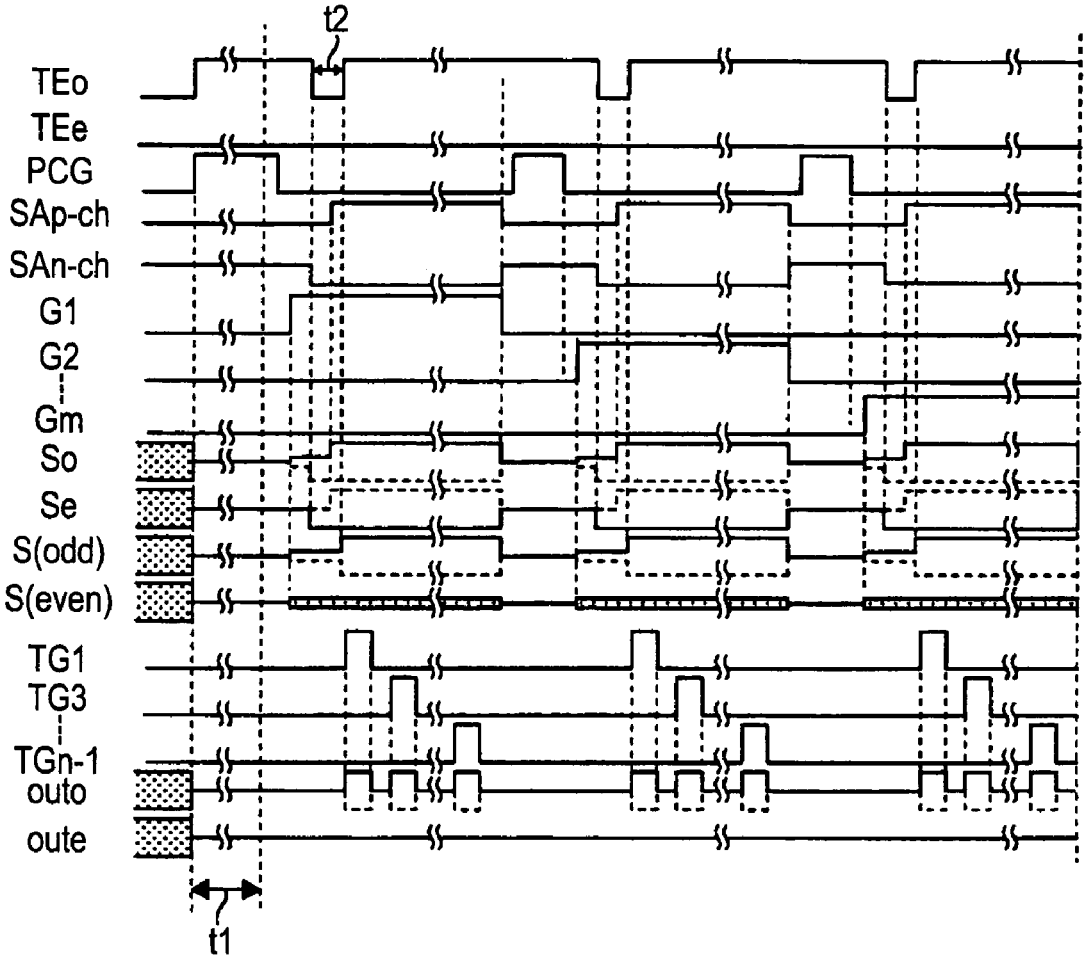
FIG. 15 is a timing chart illustrating the operation of the circuit shown in FIG. 14.

Next, the operation of the circuit shown in FIG. 14 will be described in detail with reference to a timing chart of FIG. 15. The reading operation of the pixel data corresponding to S2 of FIG. 5 will be described. FIG. 15 is the timing chart illustrating the reading operation in the circuit of FIG. 14. The test of the pixels is performed by determining whether the pixel is normal or not for every column (here, divided into the odd column and the even column). The timing signal illustrated in FIG. 15 is generated by the test device 31 and is then supplied to each terminal.

First, all scanning lines of the element array unit 2 enter an on state, so that HIGH is written in all the pixels of the odd column. Further, HIGH may be written in all the pixels of the odd column and the even column. In FIG. 14, the test of the pixels of the odd-column source line S (odd) and the test of the pixels of the even-column source line S (even) are separately performed. Furthermore, the case has been described in which HIGH is written in each pixel, but LOW may be written in each pixel. Hereinafter, an example will be described in which HIGH is written in all the pixels of the odd column and the substrate IC is tested. However, the test may be performed with respect to only some pixels. After the writing process, the gate of the scanning line G enters an off state. By allowing the test circuit connection signal TEe to become LOW in the even-column source line S (even), the influence of the potential from the display element array unit 2 is not transmitted to the differential amplifier 4*a* in the even-column source line S (even).

As shown in FIG. 15, in order to obtain a data holding time t1 after writing the above-mentioned predetermined pixel data (in this case, HIGH) in the pixels of the odd column, a precharge gate voltage PCG supplied to the terminal 16*a* of the precharge circuit unit 16 becomes HIGH, and the transistors 16*b* and 16*c* are turned on for a predetermined time. Further, a test circuit connection signal TEo of the test circuit connecting gate terminal 17*a*1 becomes HIGH. After the passage of the data holding time t1, the pixel data reading starts.

In addition, the transistors 16*b* and 16*c* are turned on for a predetermined time, so that the reference voltage Vref is generated at the nodes so and se of each differential amplifier 4*a*. Accordingly, if the gate line G enters an off state, it does not necessarily enter a precharge state. Furthermore, when the transistors 16*b* and 16*c* are turned on, the test circuit connection signal TEo of the test circuit connecting gate terminal 17*a*1 may be not yet HIGH. Therefore, when the precharge gate voltage PCG is LOW after the passage of the data holding time t1, it is shifted from LOW to HIGH, and the precharge is performed.

In the reference voltage supply unit 18, the terminal 18*a* is applied with a reference voltage Vref of an intermediate potential between HIGH and LOW which is a precharge potential. Therefore, after the predetermined pixel data is written, the source line S and the nodes se and so enter an intermediate potential state.

In addition, in order to release the precharge state after the passage of the data holding time t1, the precharge gate voltage PCG becomes LOW. However, at this time, the test circuit connection signal TEo becomes HIGH, and the potentials of the first driving pulse power supply SAp-ch and the second driving pulse power supply SAn-ch become an intermediate potential, which results in a state in which each differential amplifier 4*a* is not operated.

If the gate line G1 enters an on state right after the precharge gate voltage PCG becomes LOW, the data is simultaneously output from the individual pixels which are connected to the gate line G1. Specifically, the electric charge, which is written and held in the capacitor Cs, simultaneously moves to the corresponding source line S (odd). As shown in FIG. 15, the potential of each source line S (odd) slightly increases. If the leakage of the capacitor Cs occurs and the data of each pixel is changed to LOW, the potential of each source line S (odd) slightly decreases, as shown by a dotted line. At this time, since the test circuit connection signal TEe is LOW, the potential of the even-column source line S (even) can be ignored.

In order to operate each differential amplifier 4*a* after the gate line G1 is activated and then the predetermined time passes, first, the potential of the second driving pulse power supply SAn-ch is changed from the intermediate potential to LOW. At the same time as the time when the potential of the second driving pulse power supply SAn-ch is changed from the intermediate potential to LOW or before and after it, the test circuit connection signal TEo becomes LOW, and the transistors 17*b* of the connection gate unit 17 is turned off. As a result, information of the potential of the slightly increased odd-column source line S (odd) is confined in the differential amplifier 4*a*.

The SAn-ch driving pulse power supply becomes LOW, so that the slightly smaller potential between the potentials of the nodes so and se is changed to LOW. Therefore, each differential amplifier 4*a* compares the reference voltage Vref as an intermediate potential applied from the outside with a voltage of each odd-column source line S (odd). If the pixel is normal, the potential of each odd-column source line S (odd) is slightly higher than the intermediate potential, so that the node se of each differential amplifier 4*a* has a lower potential than the node so. For this reason, as shown in FIG. 15, the potential of the node se decreases. At this time, the potential of the node so is maintained as it is.

Next, the SAp-ch driving pulse power supply becomes HIGH, so that P-channel-type transistors 21 and 22 of the differential amplifier 4*a* are operated. That is, the SAp-ch driving pulse power supply becomes HIGH, so that the slightly larger potential between the potentials of the nodes so and se is changed to HIGH. If the pixel is normal, since the potential of the odd-column source line S (odd) is slightly higher than the intermediate potential, the node so of each differential amplifier 4*a* has a larger potential than the node se. For this reason, as shown in FIG. 15, the potential of the node so increases.

If there is a defect in the pixel, for example, if the leakage is generated in the capacitor Cs and the data of each pixel is changed to LOW, the potential of each odd-column source line S (odd) slightly decreases, as shown by a dotted line in FIG. 15. In this case, if the SAn-ch driving pulse power supply becomes LOW, the potential of the node so decreases, as shown by a dotted line in FIG. 15. In addition, if the SAp-ch driving pulse power supply becomes HIGH, the potential of the node se increases, as shown by a dotted line in FIG. 15.

In this case, since the test circuit connection signals TEo and TEe enter an off state, the source line S becoming the load is not affected by the capacitance, so that the high operation can be achieved. In addition, since the reference voltage Vref is not a potential written in the pixel, a defect of any pixel is detected as a defect of the corresponding pixel. That is, since it can be specified as a defect of one pixel, the detailed defect characteristic classification can be performed.

If logic in the nodes se and so of the differential amplifier 4*a* is fixed to any one of HIGH and LOW, the test circuit connection signal TEo is set to HIGH, and the fixed logic data is rewritten on the odd-column source line S (odd). The potential of each pixel connected to the gate line G1 is read out to the corresponding odd-column source line S (odd), odd-side gates of the transistors of the transmission gate unit 6 are opened (HIGH) in order of TG1, TG3, and TG5 up to the final TGn (or TGn−1), the pixel data of the individual pixels of the first row is sequentially read out from the image signal lines 7, and is then output to the output terminal outo (in this case, the data is not output to oute).

If the data of all pixels connected to the scanning line G1 is read out, the gate line G1 is set to LOW, and the SAn-ch driving pulse power supply and the SAp-ch driving pulse power supply are set to the intermediate potential, so that the operation of the differential amplifier 4*a* is stopped. Next, the precharge gate voltage PCG is set to HIGH, so that all the source lines S are precharged.

Hereinafter, the above-mentioned operation is repeated, and the test is sequentially performed with respect to each line of the gate lines G2 to Gm.

If the operation of the test, which is performed by writing the data of HIGH in all the pixels of the odd column, is completed, the operation of the test with respect to all the pixels of the odd column is completed by writing the data of LOW in all the pixels of the odd column and performing the same test.

Next, the pixel to be the test subject is changed to the pixel of the even column. That is, the test circuit connection signal TEo is fixed to LOW. The same test as that performed with respect to the pixels of the odd column is performed by dividing the test into a case in which data of HIGH is written in the even-column pixel and a case in which data of LOW is written in the even-column pixel while changing the test circuit connection signal TEe.

In the device of FIG. 12, one differential amplifier 4*a* is provided with respect to one source line. However, in the device of FIG. 14, since one differential amplifier 4*a* may be provided with respect to two source lines, the circuit size on the substrate can be decreased. Therefore, a size of the transistor can be increased in the differential amplifier 4*a*. As a result, since the asymmetry of the transistor in the differential amplifier 4*a* can be decreased and the driving capability of the transistor can be improved, it is possible to achieve the differential amplifier 4*a* with the stable high sensitivity.

Figure 16:
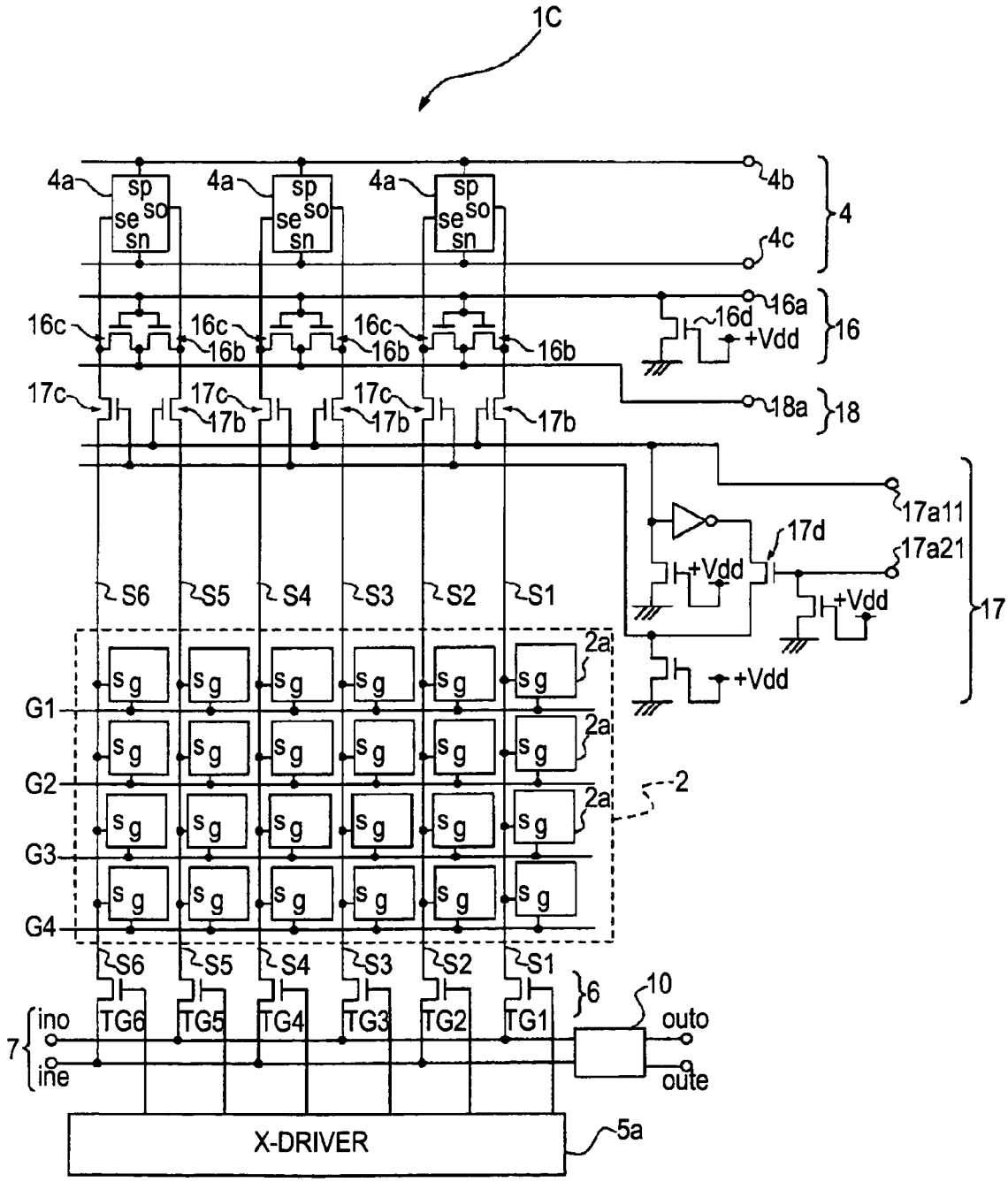
FIG. 16 is a circuit diagram illustrating an improved connection gate unit 17 of a circuit shown in FIG. 14.

FIG. 16 is a circuit diagram of a connection gate unit having improved the connection gate unit 17 of FIG. 14. As shown in FIG. 14, in the connection gate unit 17, one node so of each differential amplifier 4*a* is connected to the odd-column source line S (odd) through one transistor 17*b* of the connection gate unit 17. The other node se of each differential amplifier 4*a* is connected to the even-column source line S (even) through the other transistor 17*c* of the connection gate unit 17. In FIG. 16, the gate of the transistor 17*b* is connected to a test circuit connecting gate selection terminal 17*a*11 and is connected to a gate of the transistor 17*c* through the transistor 17*d* whose gate is connected to an inverter and a gate enable terminal 17*a*21. The gate selection terminal 17*a*11 is supplied with a test circuit connection gate selection signal TGS (Test Gate Select), and the gate enable terminal 17*a*21 is supplied with a test circuit connection signal TE (Test Enable).

Accordingly, the gate enable terminal 17*a*21 is set to HIGH, so that any one of the transistors 17*b* and 17*c* is turned on and it is possible to read only the data of any one of the pixel of the odd-column source line S (odd) and the pixel of the even-column source line S (even) by one differential amplifier 4*a*. When the test circuit connection gate selection signal TGS is HIGH, the transistor 17*b* is turned on, the transistor 17*c* is turned off, and the data of the pixel of the odd-column source line S (odd) can be read out. In contrast, when the test circuit connection gate selection signal TGS is LOW, the transistor 17*c* is turned on, the transistor 17*b* is turned off, and the data of the pixel of the even-column source line S (even) can be read out. In a state in which a voltage signal is not applied to the gate selection terminal 17*a*11 and the gate enable terminal 17*a*21, that is, in a floating state, the transistors 17*b* and 17*c* are turned off, and the test circuit is separated.

As such, since the inverter is inserted between the gates of the transistors 17*b* and 17*c*, it can be prevented that the odd-column source line S (odd) and the even-column source line S (even) are simultaneously connected to the differential amplifier 4*a*, so that it is possible to prevent the erroneous operation in advance.

Structure of Substrate in First Embodiment

Figure 17:
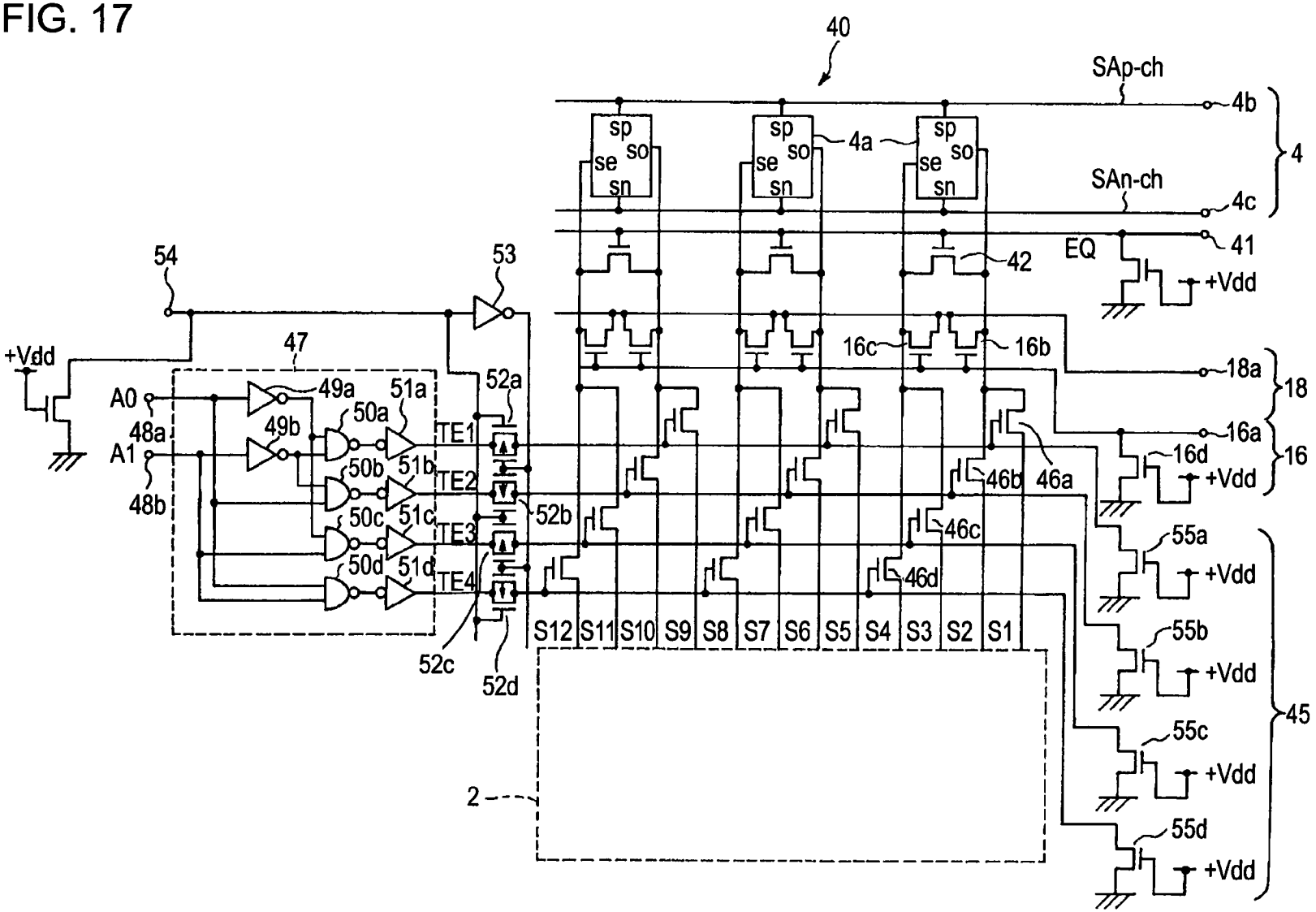
FIG. 17 is a circuit diagram illustrating a first embodiment applied to a substrate of FIG. 14.

FIG. 17 illustrates the first embodiment applied to the third example of the substrate of FIG. 14. In the present embodiment, an occupied area of the test circuit of the substrate for an electro-optical device shown in FIG. 14 is reduced. Alternatively, an occupied area per differential amplifier constituting the test circuit is increased and the performance of the test circuit is improved. In FIG. 17, the same constituent elements as FIG. 14 will be denoted by the same reference numerals and the description thereof will be omitted.

In the device of FIG. 14, each differential amplifier 4*a* is provided to correspond to the two source lines composed of the odd-column source line and the even-column source line. However, generally, in order to constitute the differential amplifier, the relative large area is required on the semiconductor substrate. Accordingly, in the present embodiment, one differential amplifier 4*a* corresponds to the plurality of source lines, the number of the differential amplifiers 4*a* on the substrate is reduced, and the occupied are on the substrate per differential amplifier is ensured.

The element substrate 40, which is a substrate for an electro-optical device according to the present embodiment, is different from the substrate for an electro-optical device of FIG. 14 in that one differential amplifier 4*a* corresponds to three source lines or more, and a connection gate unit 45 serving as a connection unit is employed instead of the connection gate unit 17.

In FIG. 14, each of the nodes so and se of the differential amplifier 4*a* is connected to one source line through each of the transistors 17*b* and 17*c* of the connection gate unit 17. In the present embodiment, the nodes so and se of the differential amplifier 4*a* are connected to three source lines or more using three transistors or more. FIG. 17 shows an example in which each of the nodes so and se are connected to the two source lines.

In FIG. 17, each differential amplifier 4*a* is provided with respect to four source lines. A signal line connected to the node so of the differential amplifier 4*a* is divided into two signal lines, so that each of the two signal lines is connected to the source line of the (4u+1)-th column (u=0, 1, 2, . . . ) or the source line of the (4u+2)-th column through the transistor 46*a* or the transistor 46*b*. In the same manner, a signal line connected to the node se of the differential amplifier 4*a* is divided into two signal lines, so that each of the two signal lines is connected to the source line of the (4u+3)-th column or the source line of the (4u+4)-th column through the transistor 46*c* or the transistor 46*d*.

In addition, the transistors 46*a* to 46*d* are disposed at the same distance from the nodes so and se of the differential amplifier 4*a*.

The gate of the transistor 46*a* provided for every fourth source line 4 is commonly connected to the gate signal line connected to the output terminal of the transfer gate 52*a*. A pull-down circuit 55*a* is connected to the other terminal of the gate signal line. In the same manner, the gate of the transistor 46*b* provided for every fourth source line is commonly connected to the gate signal line connected to the output terminal of the transfer gate 52*b*. A pull-down circuit 55*b* is connected to the other terminal of the gate signal line. Further, the gate of the transistor 46*c* is commonly connected to the gate signal line connected to the output terminal of the transfer gate 52*c*. A pull-down circuit 55*c* is connected to the other terminal of the gate signal line. Furthermore, the gate of the transistor 46*d* is commonly connected to the gate signal line connected to the output terminal of the transfer gate 52*d*. A pull-down circuit 55*d* is connected to the other terminal of the gate signal line.

Each of the transfer gates 52*a* to 52*d* has a structure in which an n-channel transistor and a p-channel transistor are complementarily connected. The input terminals of the transfer gates 52*a* to 52*d* are individually supplied with the corresponding outputs TE1 to TE4 of a gate decode circuit 47. In each of the transfer gates 52*a* to 52*d*, a signal is input from the test circuit connection gate terminal 54 to the gate of the n-channel transistor. The inverter 53 inverts the output of the test circuit connection gate terminal 54 to supply it to the gate of the p-channel transistor of each of the transfer gates 52*a* to 52*d*. A pull-down circuit is connected to the test circuit connection gate terminal 54. When the signal is not input to the test circuit connection gate terminal 54, the pull-down circuits set the input side of the inverter 53 to LOW such that the transfer gates 52*a* to 52*d* enter a non-conductive state. If the connection gate signal TE of HIGH is input to the test circuit connection gate terminal 54, the transfer gates 52*a* to 52*d* transmit the test circuit connection signals TE1 to TE4 from the gate decode circuit 47 to the corresponding gate signal lines.

The gate decode circuit 47 has inverters 49*a* and 49*b* to which selection information A0 and A1 input to the terminals 48*a* and 48*b* are input, respectively. The inverters 49*a* and 49*b* invert the input selection information A0 and A1, respectively. The NAND circuit 50*a* performs NAND operation with respect to the outputs of the inverters 49*a* and 49*b*. The NAND circuit 50*b* performs NAND operation between the output of the inverter 49*a* and the selection information A1. The NAND circuit 50*c* performs NAND operation between the output of the inverter 49*b* and the selection information A0. The NAND circuit 50*d* performs NAND operation between the selection information A0 and A1. The outputs of the NAND circuits 50*a* to 50*d* are supplied to the inverters 51*a* to 51*d*, respectively. The outputs of the inverters 51*a* to 51*d* are respectively output to the transfer gates 52*a* to 52*d* as the test circuit connection signals TE1 to TE4.

FIG. 18 is a diagram illustrating a truth value table of the gate decode circuit 47. As shown in FIG. 18, the selection information A0 and A1 are suitably selected, so that any one of the test circuit connection signals TE1 to TE4 can be selectively set to HIGH.

FIG. 14 is a diagram illustrating an example in which one transistor serving as the precharge transistor and the equalization transistor is commonly used. In contrast, in the present embodiment, the equalization transistor 42 and the precharge transistors 16*b* and 16*c* are separately provided. Thereby, the precharge period and the equalization period can be independently controlled.

Figure 19:
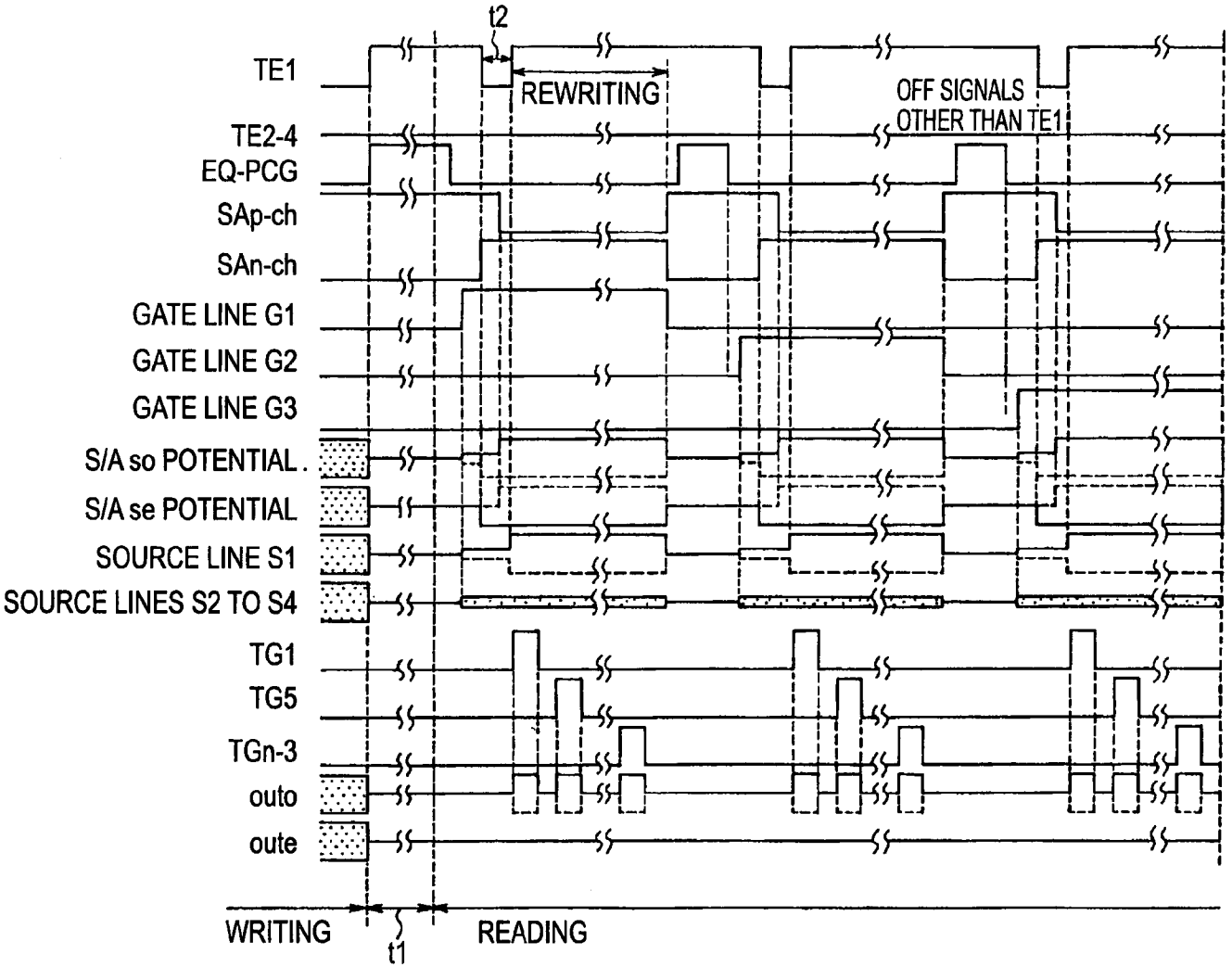
FIG. 19 is a timing chart illustrating the reading operation in a circuit shown in FIG. 17.

Next, the test method according to the present embodiment having the above-mentioned structure will be described with reference to the timing chart of FIG. 19. FIG. 19 is a timing chart illustrating the reading operation in the circuit of FIG. 17. The pixel test is performed for every fourth source line. FIG. 19 illustrates an example in which only the pixels connected to the source lines S1, S5, . . . are tested. This test method is different from the test method of FIG. 15 in that the connection gate unit 45 selects the tested source line. The timing signal illustrated in FIG. 19 is generated by the test device 31 and is then supplied to each terminal.

First, all the scanning lines G of the element array unit 2 enter an on state, and HIGH is written in all the pixels for every fourth source line. In addition, HIGH may be written in all the pixels. Further, the case has been described in which HIGH is written in each pixel. However, although LOW is written in each pixel, the same test can be performed. After the writing process, the gate of the scanning line G enters an off state.

Next, the column of pixels for performing the test (source line) is selected. For example, the source lines S1, S5, . . . are selected. In this case, (0, 0) as the selection information A0 and A1 are given to the terminals 48*a* and 48*b*. As shown in FIG. 18, the gate decode circuit 47 sets only the test circuit connection signal TE1 to HIGH on the basis of the selection information (0, 0) and sets the other test circuit connection signals TE2 to TE4 to LOW. In addition, at the time of performing the test, the connection gate signal TE of HIGH is input to the terminal 54, and each of the transfer gates 52*a* to 52*d* transmits the output of the gate decode circuit 47 to each gate signal line.

Thereby, a signal of HIGH is supplied to the gate of the transistor 46*a*, so that the transistor 46*a* is turned on. The source lines S1, S5, . . . for every fourth source line and the signal lines connected to the nodes so of the differential amplifiers 4*a* are connected to each other.

Since the test circuit connection signals TE2 to TE4 are LOW, the other transistors 46*b* to 46*d* are turned off. The other source lines S2 to S4, S6 to S8, . . . are not connected to the nodes so and se of the differential amplifiers 4*a*, and the influence of the potential from the display element array unit 2 through these source lines is not transmitted to the differential amplifiers 4*a*.

As shown in FIG. 19, in order to obtain a data holding time t1 after writing the above-mentioned predetermined pixel data (in this case, HIGH) in all the pixels for every fourth source line, a precharge gate voltage PCG supplied to the terminal 16*a* of the precharge circuit unit 16 becomes HIGH, and the transistors 16*b* and 16*c* are turned on for a predetermined time. Thereby, the nodes so and se of the differential amplifier 4*a* are supplied with the precharge voltage Vpre from the terminal 18*a* of the reference voltage supply unit 18. In addition, in this case, the equalizing gate voltage EQ applied to the terminal 41 is set to a high level, so that the nodes so and se become have the same potential. Here, since PCG and EQ have the same waveform, FIG. 19 illustrates one waveform.

In the reference voltage supply unit 18, the terminal 18*a* is applied with a precharge voltage Vpre of an intermediate potential between HIGH and LOW which is a precharge potential. Therefore, after the predetermined pixel data is written, the nodes se and so enter an intermediate potential state.

In addition, the reading of the pixel data starts after the passage of the data holding time t1. That is, in order to release the precharge state after the passage of the data holding time t1, the precharge gate voltage PCG becomes LOW. At this time, the test circuit connection signal TE1 becomes HIGH, and the potentials of the first driving pulse power supply SAp-ch and the second driving pulse power supply SAn-ch become an intermediate potential, which results in a state in which each differential amplifier 4*a* is not operated.

If the gate line G1 enters an on state right after the precharge gate voltage PCG becomes LOW, the data is simultaneously output from the individual pixels which are connected to the gate line G1. Specifically, the electric charge, which is written and held in the capacitor Cs, moves simultaneously to the corresponding source lines S1, S5, . . . . As shown in FIG. 19, the potential of each of the source lines S1, S5, . . . slightly increase. If the leakage of the capacitor Cs occurs and the data of each pixel is changed to LOW, the potential of each of the source line S1, S5, . . . slightly decreases, as shown by a dotted line. At this time, since the test circuit connection signals TE2 to TE4 are LOW and the transistors 46*b* to 46*d* are turned off, the potentials of the other source lines S2 to S4, S6 to S8, can be ignored.

In order to operate each differential amplifier 4*a* after the gate line G1 is activated and then the predetermined time passes, first, the potential of the second driving pulse power supply SAn-ch is changed from the intermediate potential to LOW. At the same time as the time when the potential of the second driving pulse power supply SAn-ch is changed from the intermediate potential to LOW or before and after it, the test circuit connection signal TE1 becomes LOW, and the transistor 46*a* of the connection gate unit 17 is turned off. As a result, information of the potentials of the slightly increased source lines S1, S5, is confined in the differential amplifier 4*a*.

The SAn-ch driving pulse power supply becomes LOW, so that the potential slightly lower than the intermediate potential between the potentials of the nodes so and se is changed to LOW. Each differential amplifier 4*a* compares the precharge voltage Vpre as an intermediate potential applied from the outside with a voltage of each of the source lines S1, S5, . . . . If the pixel is normal, the potential of each of the source lines S1, S5, . . . is slightly higher than the intermediate potential, so that the node se of each differential amplifier 4*a* has a lower potential than the node so. For this reason, as shown in FIG. 19, the potential of the node se decreases. At this time, the potential of the node so is maintained as it is.

Next, the SAp-ch driving pulse power supply becomes HIGH, so that P-channel-type transistors 21 and 22 of the differential amplifier 4*a* are operated. That is, the SAP-ch driving pulse power supply becomes HIGH, so that the potential slightly higher than the intermediate potential between the potentials of the nodes so and se is changed to HIGH. If the pixel is normal, since the potentials of the source lines S1, S5, . . . are slightly higher than the intermediate potential, the node so of each differential amplifier 4*a* has a larger potential than the node se. For this reason, as shown in FIG. 19, the potential of the node so increases.

If there is a defect in the pixel, for example, if the leakage is generated in the capacitor Cs and the data of each pixel is changed to LOW, the potential of each of the source lines S1, S5, . . . slightly decreases, as shown by a dotted line in FIG. 19. In this case, if the SAn-ch driving pulse power supply becomes LOW, the potential of the node so decreases, as shown by a dotted line in FIG. 19. In addition, if the SAp-ch driving pulse power supply becomes HIGH, the potential of the node se increases, as shown by a dotted line in FIG. 19.

In this case, since the test circuit connection signals TE1 to TE4 become LOW and the transistors 46*a* to 46*d* are turned off, the source line S becoming the load is not affected by the capacitance, so that the high operation can be achieved. In addition, since the precharge voltage Vpre is not obtained by the pixel writing potential, a defect of any pixel is detected as a defect of the corresponding pixel, and the detailed defect characteristic classification can be performed.

If logic in the nodes se and so of the differential amplifier 4*a* is fixed to any one of HIGH and LOW, the test circuit connection signal TE1 is set to HIGH, and the fixed logic data is rewritten on each of the source lines S1, S5, . . . . The potential of each pixel connected to the gate line G1 is read out to each of the corresponding source lines S1, S5, . . . , gates of the transistors of the transmission gate unit 6 are opened (HIGH) in order of TG1, TG5, and TG9 up to the final TGn (or TGn−1), the pixel data of the individual pixels of the first row is sequentially read out from the image signal lines 7, and is then output to the output terminal outo.

If the data of all pixels connected to the gate line G1 is read out, the gate line G1 is set to LOW, and the SAn-ch driving pulse power supply and the SAp-ch driving pulse power supply are set to the intermediate potential, so that the operation of the differential amplifier 4*a* is stopped. Next, the precharge gate voltage PCG is set to HIGH, so that all the source lines S are precharged.

Hereinafter, the above-mentioned operation is repeated, and the test is sequentially performed with respect to each line of the gate lines G2 to Gm.

If the operation of the test, which is performed by writing the data of HIGH in all the pixels of the first-column source line among the source lines for every fourth source line, is completed, the data of LOW is written in all the pixels of the second-column source line among the source lines for every fourth source line, the same test is performed, and the test is performed with respect to all the pixels of the second-column source line among the source lines for every fourth source line. That is, in this case, the test circuit connection signal TE2 is set to HIGH or LOW and the other test circuit connection signals TE1, TE3, and TE4 are set to LOW, so that the test is performed with respect to all the pixels of the second-column source line among the source lines for every fourth source line.

Next, the pixels to be the test subject are changed to the pixels of the node se side of the differential amplifier 4*a*. That is, test circuit connection signals TE1, TE2, and TE4 are fixed to LOW and the test circuit connection signal TE3 is set to HIGH or LOW, so that the test is performed with respect to all the pixels of the third-column source line among the source lines for every fourth source line. Next, the test circuit connection signals TE1 to TE3 are fixed to LOW and the test circuit connection signal TE4 is set to HIGH or LOW, so that the test is performed with respect to all the pixels of the fourth-column source line among the source lines for every fourth source line. In this way, the test for all pixels is completed.

As described above, in the device of FIG. 14, one differential amplifier 4*a* is provided with respect to two source lines composed of the even-column source line and the odd-column source line. However, in the device of FIG. 17, since one differential amplifier 4*a* may be provided with respect to four source lines, the area occupied by all the differential amplifiers on the substrate can be decreased. Therefore, a size of each transistor can be increased in each of the differential amplifiers 4*a* provided on the substrate. As a result, since the asymmetry of the transistor in the differential amplifier 4*a* can be decreased and the driving capability of the transistor can be improved, it is possible to achieve the differential amplifier 4*a* with the stable high sensitivity.

Figure 20:
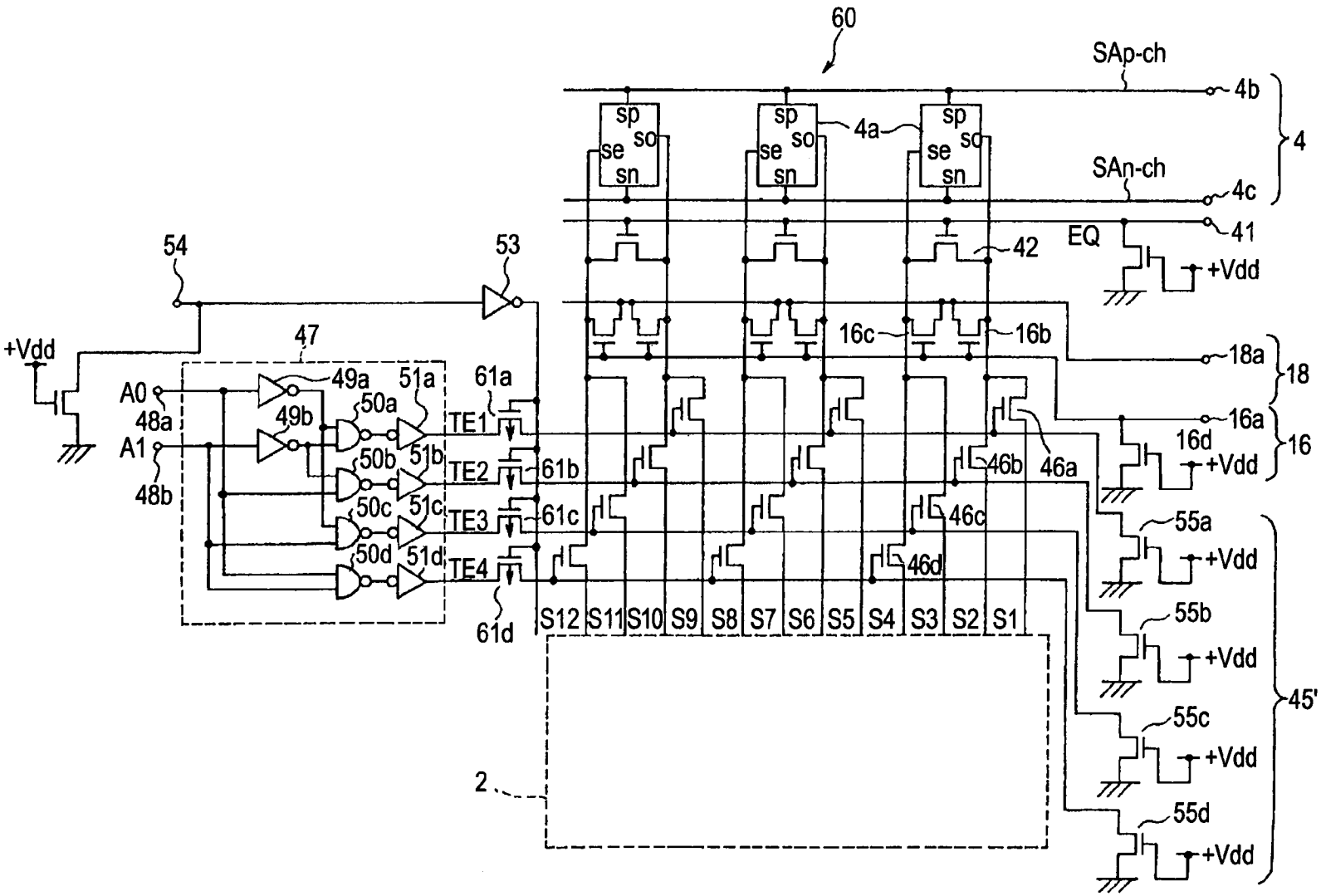
FIG. 20 is a circuit diagram illustrating a second embodiment of the invention.

FIG. 20 is a circuit diagram illustrating a second embodiment of the invention. In FIG. 20, the same constituent elements as FIG. 17 will be denoted by the same reference numerals and the description thereof will be omitted.

The second embodiment is different from the first embodiment in that the a connection gate 45' is used instead of the connection gate unit 45. The connection gate unit 45' is different from the connection gate 45 in that transfer gates 61*a* to 61*d* are used instead of the transfer gates 52*a* to 52*d*.

Each of the transfer gates 61*a* to 61*d* is composed of a p-channel transistor, and the output of the inverter 53 is supplied to the gate of the p-channel transistor. The inverter 53 inverts the connection gate signal TE from the terminal 54 to supply it to the gate of each of the transfer gates 61*a* to 61*d*. A connection gate signal TE of HIGH is input to the terminal 54, so that each of the transfer gates 61*a* to 61*d* is supplied with a power, and supplies the output of the gate decode circuit 47 to each gate signal line.

In the present embodiment having the above-mentioned structure, the test circuit connection signals TE1 to TE4 from the gate decode circuit 47 are transmitted to the corresponding gate signal lines through the transfer gates 61*a* to 61*d*. The other operation is the same as that of the first embodiment.

In the present embodiment, the test circuit connection signals TE1 to TE4, which turn on the transistors 46*a* to 46*d*, become HIGH. The HIGH signal is transmitted to each of the transfer gates 61*a* to 61*d*, each being composed of the p-channel transistor. In contrast, the transmission of the LOW signal, which turn off the transistors 46*a* and 46*b*, can be achieved by that when the HIGH signal is not transmitted, the gate potentials of the transistors 46*a* and 46*b* are held as LOW by the pull-down circuits 55*a* to 55*d*. For this reason, it is possible to suitably transmit the test circuit connection signals TE1 to TE4 to gates of the transistors 46*a* to 46*d* through the transfer gates 61*a* to 61*d* each being composed of the p channel without using the complementary transfer gate.

Figure 21:
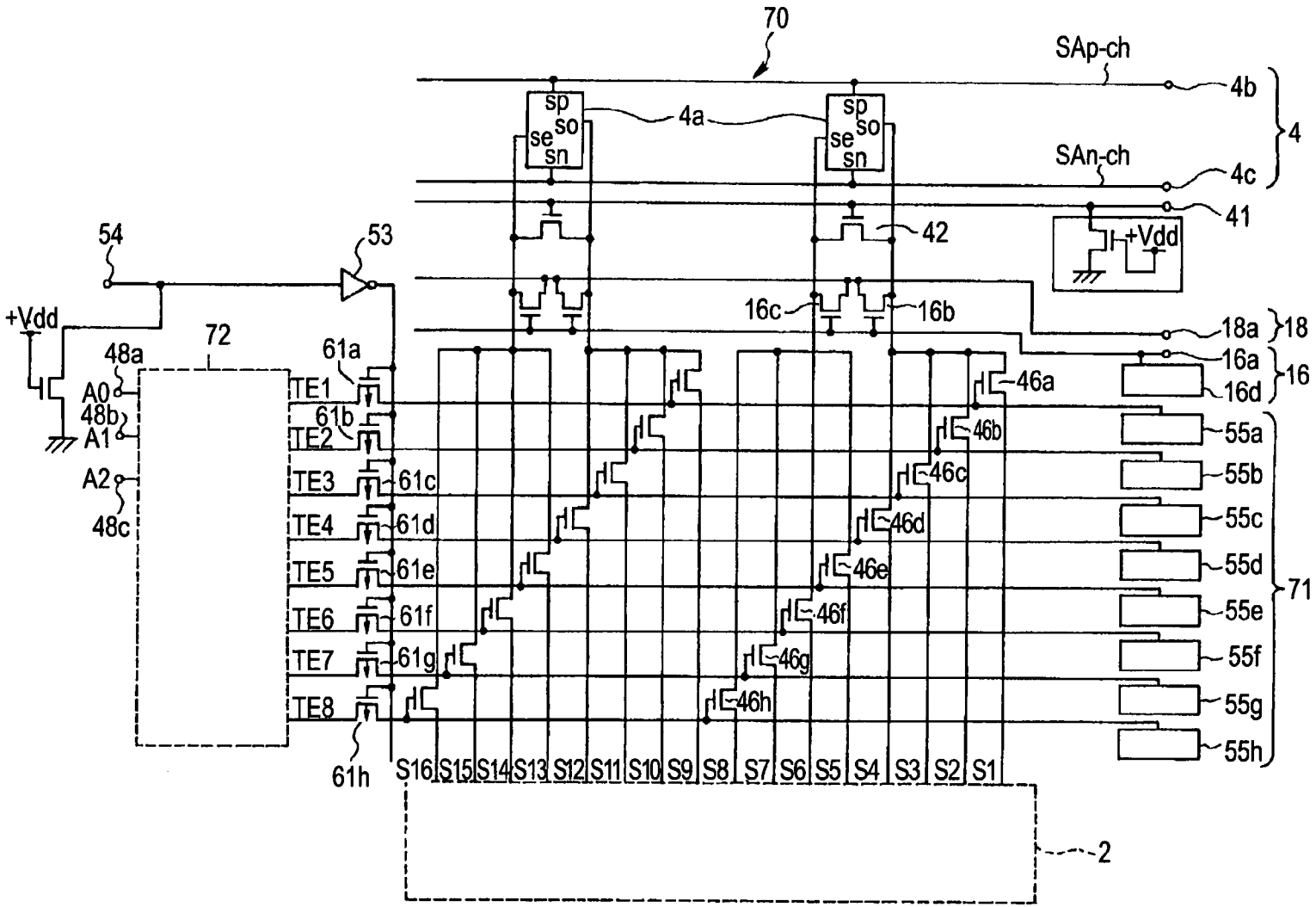
FIG. 21 is a circuit diagram illustrating a third embodiment of the invention.

FIG. 21 is a circuit diagram illustrating a third embodiment of the invention. In FIG. 21, the same constituent elements as FIG. 20 will be denoted by the same reference numerals and the description thereof will be omitted.

As described above, it is possible to make three source lines or more correspond to one differential amplifier 4*a*. In the present embodiment, eight source lines correspond to one differential amplifier 4*a*.

The element substrate 70, which is a substrate for an electro-optical device according to the present embodiment, is different from the substrate for an electro-optical device of FIG. 20 in that a connection gate unit 71 is used instead of the connection gate unit 45.

In the present embodiment, the nodes so and se of the differential amplifier 4*a* are connected to eight source lines using eight transistors 46*a* to 46*h*. That is, one differential amplifier 4*a* is provided for the eight source lines. A signal line connected to the node so of the differential amplifier 4*a* is divided into four signal lines, so that the four signal lines are connected to the source line of the (8u+1)-th column, the source line of the (8u+2)-th column, the source line of the (8u+3)-th column, and the source line of the (8u+4)-th column through the transistors 46*a* to 46*d*. In the same manner, a signal line connected to the node se of the differential amplifier 4*a* is divided into four signal lines, so that the four signal lines are connected to the source line of the (8u+5)-th column, the source line of the (8u+6)-th column, the source line of the (8u+7)-th column, and the source line of the (8u+8)-th column through the transistors 46*e* to 46*h*.

The gate of the transistor 46*a* provided for every eighth source line is commonly connected to the gate signal line connected to the output terminal of the transfer gate 61*a*. A pull-down circuit 55*a* is connected to the other terminal of the gate signal line. In the same manner, the output terminals of the transfer gates 61*b* to 61*h* are connected to seven gate signal lines, and gates of the transistors 46*b* to 46*h* each provided for every eighth source line are commonly connected to the seven gate signal lines.

In addition, the pull-down circuits 55*b* to 55*h* are connected to the other ends of the seven gate signal lines.

Each of the transfer gates 61*a* to 61*h* is composed of a p-channel transistor. The input terminals of the transfer gates 61*a* to 61*h* are individually supplied with the corresponding outputs TE1 to TE8 of a gate decode circuit 72. In each of the transfer gates 61*a* to 61*h*, the output of the inverter 53 is supplied to the gate of the p-channel transistor. If the connection gate signal TE of HIGH is input to the test circuit connection gate terminal 54, the transfer gates 61*a* to 61*h* transmit the test circuit connection signals TE1 to TE8 from the gate decode circuit 72 to the corresponding gate signal lines.

The gate decode circuit 72 generates test circuit connection signals TE1 to TE8 on the basis of the selection information A0 to A2 input to the terminals 48*a* to 48*c*. Any one of the test circuit connection signals TE1 to TE8 generated by the gate decode circuit 72 becomes HIGH selectively, and the other signals become LOW.

The other structure is the same as that of FIG. 20.

In the third embodiment constructed in this way, the same test method as the second embodiment is used. That is, in the present embodiment, the test is performed on the basis of the same timing chart as FIG. 19. Each pixel test in the present embodiment is performed for every eighth source line. For example, first, only the pixels connected to the source lines S1, S9, . . . are tested. In this case, the selection information A0 to A2 are suitably selected, the test circuit connection signal TE1 from the gate decode circuit 72 is set to HIGH or LOW, the other test circuit connection signals TE2 to TE8 are set to LOW, and the test is performed with respect to all the pixels of the first-column source line among the source lines for every eighth source line.

If the operation of the test, which is performed by writing the data of HIGH in all the pixels of the first-column source line among the source lines for every eighth source line, is completed, the data of LOW is written in all the pixels of the second-column source line among the source lines for every eighth source line, the same test is performed, and the test is performed with respect to all the pixels of the second-column source line among the source lines for every eighth source line. That is, in this case, the test circuit connection signal TE2 is set to HIGH or LOW and the other test circuit connection signals TE1 and TE3 to TE8 are set to LOW. Hereinafter, in the same manner, the other test circuit connection signals TE3 to TE8 become HIGH sequentially, so that the test is performed with respect to all the pixels of the first-column source line to the eighth-column source line among the source lines for every eighth source line.

The other operation is the same as that of the second embodiment.

In the present embodiment having the above-mentioned structure, since one differential amplifier 4*a* may be provided with respect to the eight source lines, it is possible to further increase an area occupied by one differential amplifier 4*a*.

However, in the above-mentioned embodiments, the power supply voltage Vdd and the grounding potential are used as the first driving pulse power supply SAp-ch and the second driving pulse power supply SAn-ch supplied to the differential amplifier 4*a*. However, when the driving pulse power supply of the power supply voltage level is switched and the differential amplifier 4*a* is driven, the sufficient driving force cannot be obtained. Accordingly, in general, it is considered that the structure shown in FIG. 22 is used.

Figure 22:
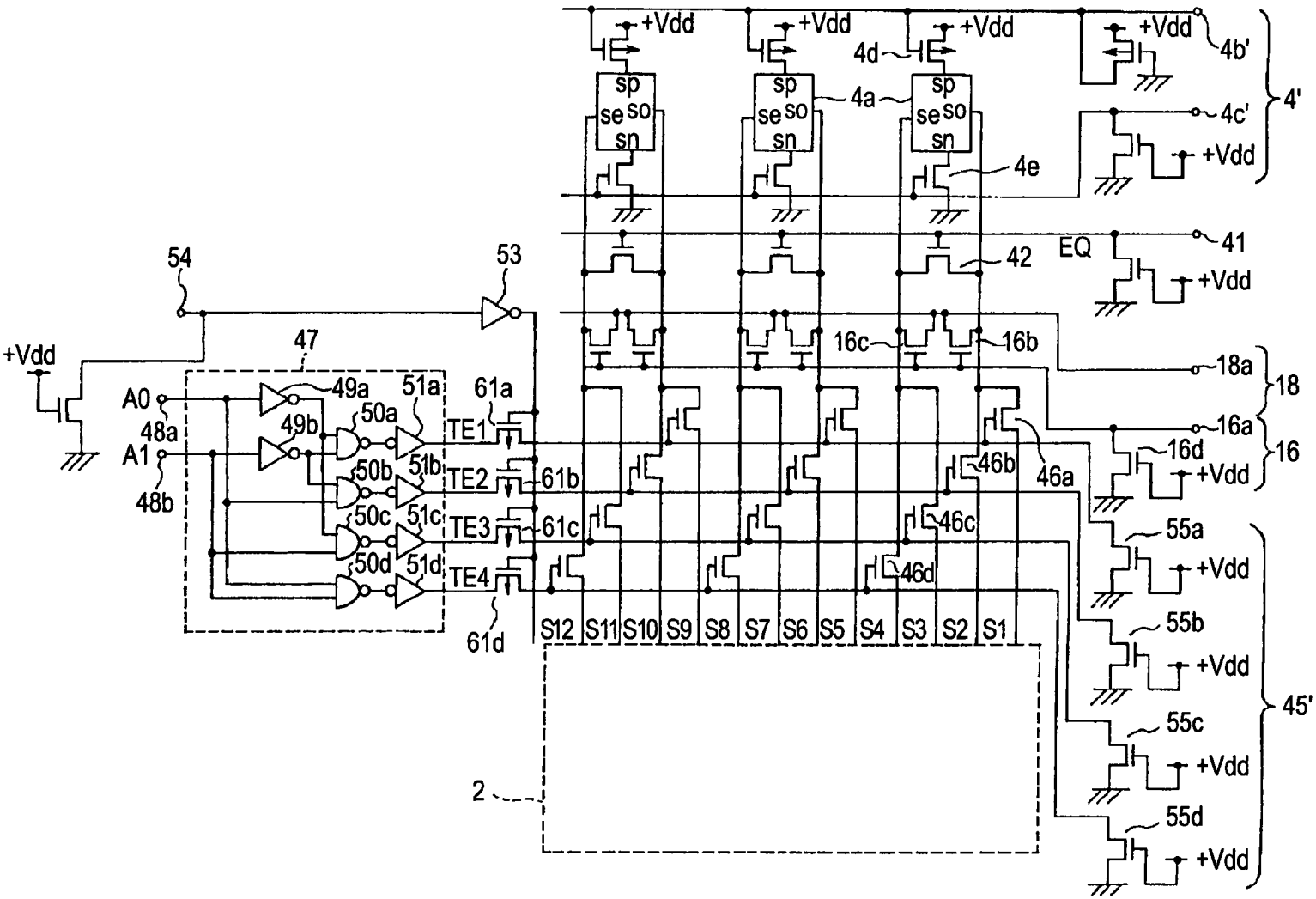
FIG. 22 is a circuit diagram illustrating another example of a display data reading circuit unit.

In FIG. 22, the display data reading circuit unit 4' supplies the first driving pulse to the gate of the transistor 4*d* through the terminal 4*b*', and supplies the second driving pulse to the gate of the transistor 4*e* through the terminal 4*c*'. Thereby, the transistor 4*d* is turned on and the transistor 4*e* is turned off. The transistor 4*d* has its source connected to the power supply terminal Vdd and its drain connected to the node sp of the differential amplifier 4*a*. In addition, the transistor 4*e* has its drain connected to the node sn of the differential amplifier 4*a* and its source connected to the reference potential point.

The second driving pulse becomes HIGH, so that the potential of the node sn of the differential amplifier 4*a* becomes a potential of the reference potential point. The first driving pulse becomes LOW, so that the potential of the node sp of the differential amplifier 4*a* becomes a power supply voltage Vdd. Since it is not necessary to change the power supply voltage vdd and the potential of the reference potential point, it is possible to suitably drive the differential amplifier 4*a*.

Figure 23:
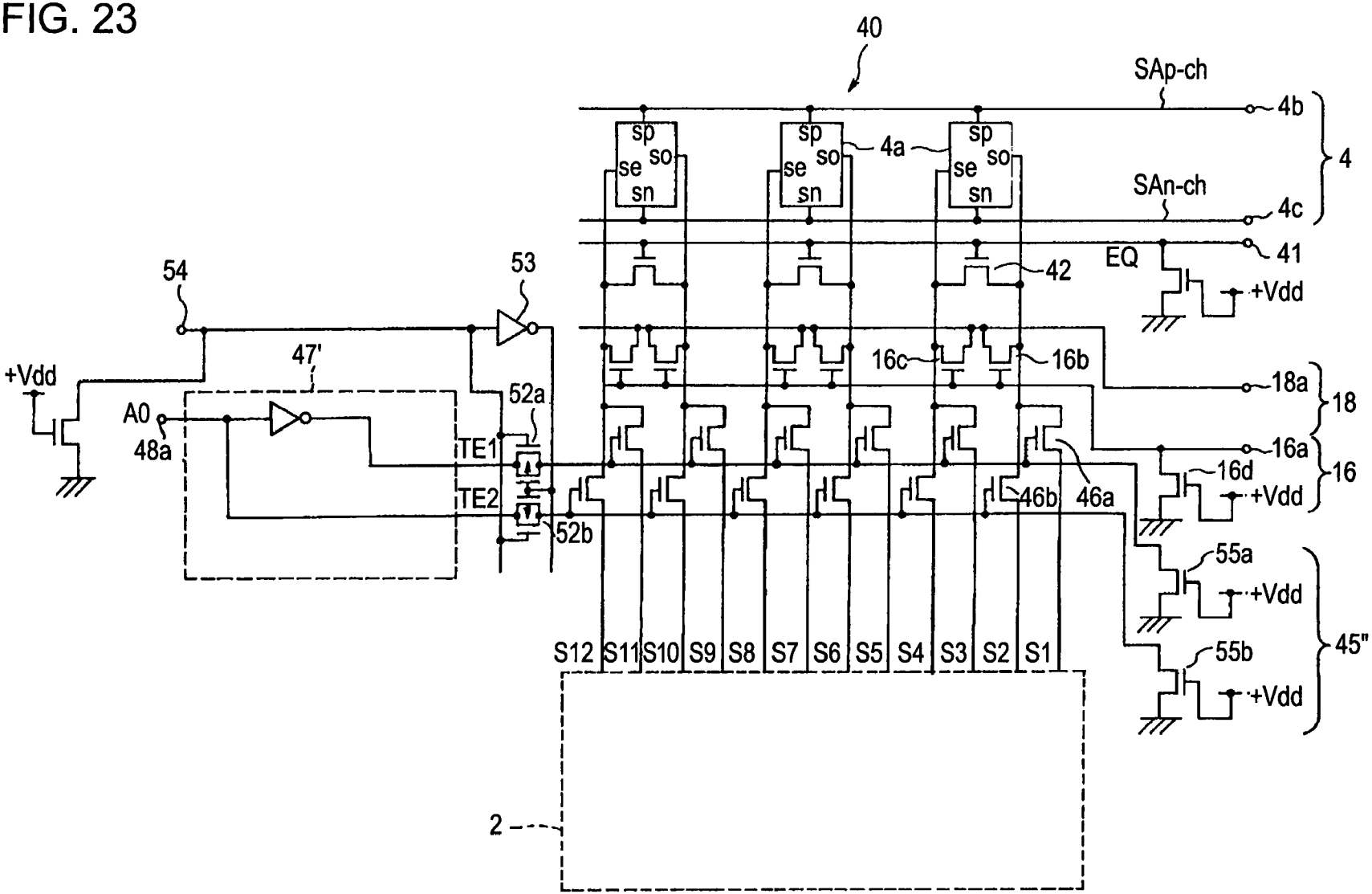
FIG. 23 is a circuit diagram illustrating a modification.
Figure 24:
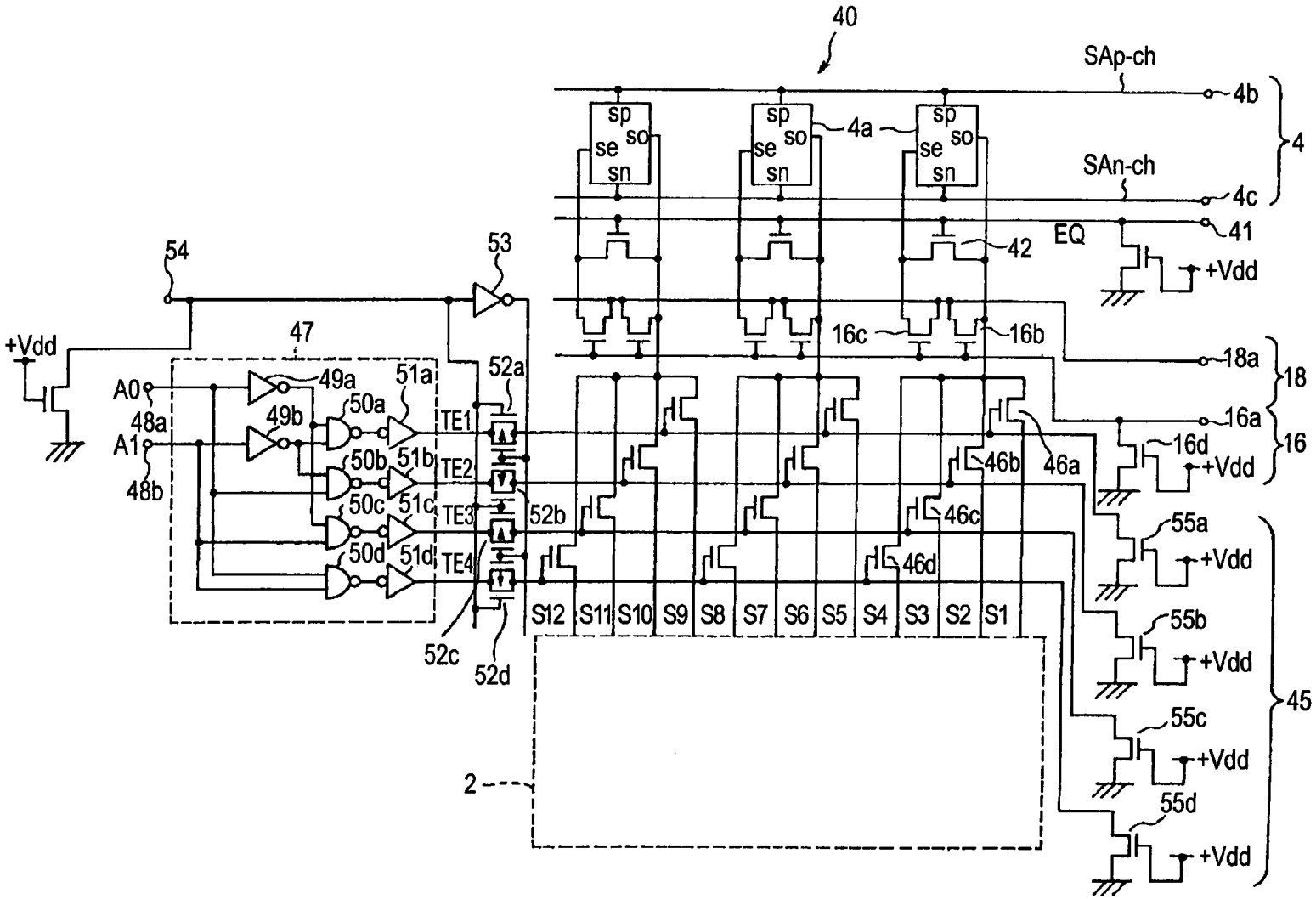
FIG. 24 is a circuit diagram illustrating a modification.
Figure 25:
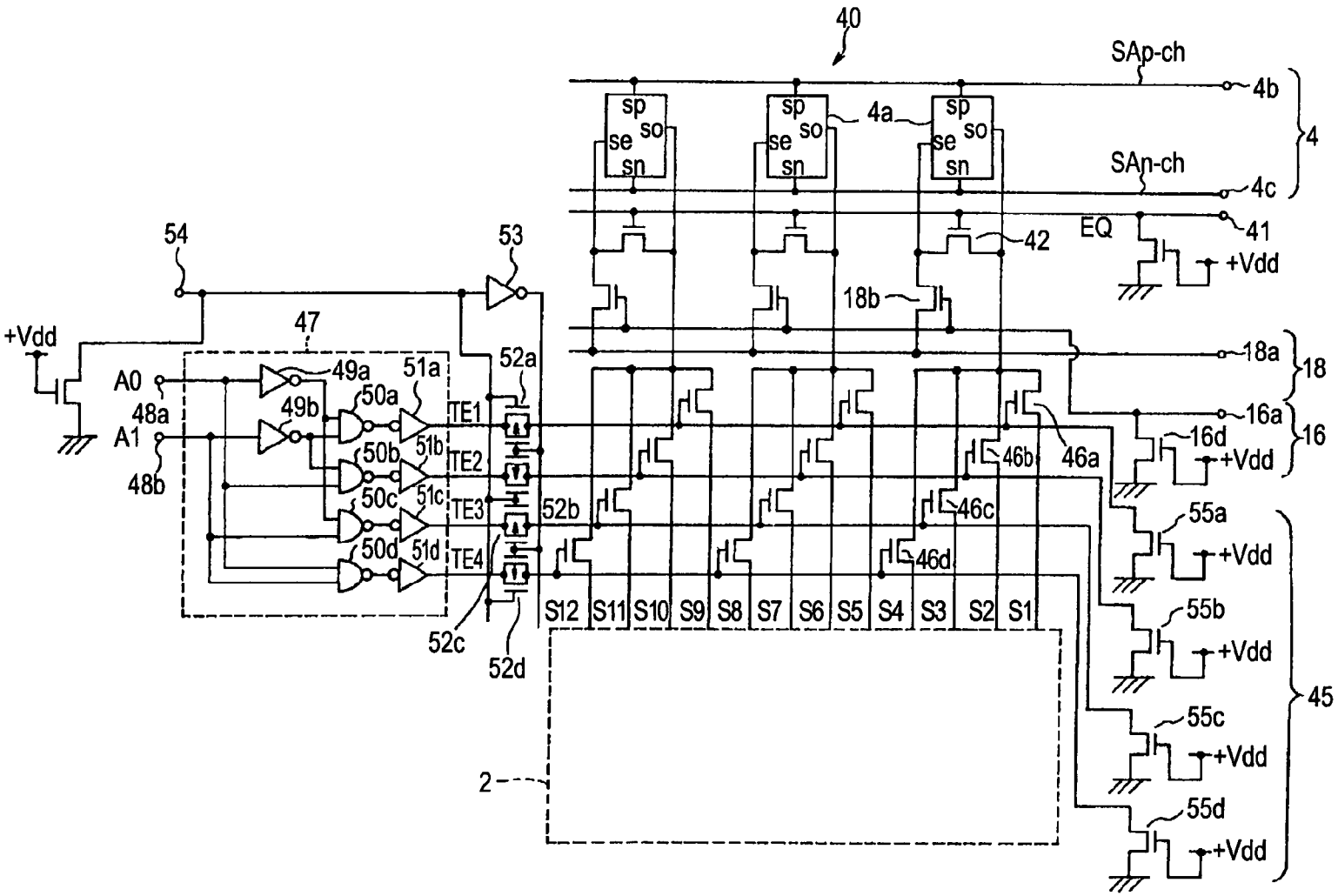
FIG. 25 is a circuit diagram illustrating a modification.

FIGS. 23 to 25 are circuit diagrams illustrating a modification. In FIGS. 23 to 25, the same constituent elements as FIG. 17 will be denoted by the same reference numerals and the description thereof will be omitted.

Each of the above-mentioned embodiments illustrates an example using the transfer gates 52*a* to 52*d* corresponding to the number of the source lines connected to the differential amplifier 4*a*. The modification of FIG. 23 illustrates an example using two systems of transfer gates 52*a* and 52*b*.

That is, in FIG. 23, the transistor 46*a*, which connects each of the nodes so and se to each source line of the odd column, is controlled through the common transfer gate 52*a*, and the transistor 46*a*, which connects each of the nodes so and se to each source line of the even column, is controlled through the common transfer gate 52*b*.

In the modification having the above-mentioned structure, if the gate signal line becomes HIGH by the transfer gate 52*a*, the source lines S1, S3, . . . of the odd columns are connected to the nodes so and se of the differential amplifier 4*a*. In addition, if the gate signal line becomes HIGH by the transfer gate 52*b*, the source lines S2, S4, . . . of the even columns are connected to the nodes so and se of the differential amplifier 4*a*. In this way, the corresponding source lines are connected to each of the nodes so and se of the differential amplifier.

The other operation and effect is the same as that of each of the above-mentioned embodiments.

In addition, each of the above-mentioned embodiments illustrates an example in which any one of the nodes so and se of the differential amplifier 4*a* is connected to the source line. In contrast, the modification of FIG. 24 illustrates an example in which only one node so is connected to the source line so as to correspond to the second example of the substrate.

That is, in FIG. 24, each node so of the differential amplifier 4*a* is connected to the four source lines through the transistors 46*a* to 46*d*. In contrast, each node se of the differential amplifier 4*a* is connected to the terminal 18*a* through the transistor 16*c*. In addition, the node se may be connected to the source line and the node so may be connected to the terminal 18*a*.

Even in the modification constructed in this way, the signal of HIGH is supplied to the gate signal line through each of the transfer gates 52*a* to 52*d*, so that the source line for every fourth source line can be connected to the node so of the differential amplifier 4*a*.

The other operation and effect is the same as that of each of the above-mentioned embodiments.

FIG. 25 illustrates an example in which the equalizing transistor is removed from the modification of FIG. 24.

An example of FIG. 25 is different from the modification of FIG. 24 in that the transistors 46*a* and 46*b* are removed and the transistor 18*b* is additionally provided. The output of the gate terminal 16*a* is supplied to the transistor 18*b* such that the node se of the differential amplifier 4*a* is connected to the terminal 18*a*. The transistors 42 and 18*b* are simultaneously turned on, so that it is possible to equalize the level of the signal line connected to the nodes so and se of the differential amplifier 4*a* to a level of the terminal 18*a*. That is, it is possible to transmit the reference voltage applied to the node se to the node so through the transistor 18*b*. Thereby, it is possible to reduce the number of the transistors, as compared with the modification of FIG. 24.

The other operation is the same as that of each of the above-mentioned embodiments.

As described above, in the above-mentioned three embodiments, a substrate for an active-matrix-type display device has been exemplified for the substrate for an electro-optical device of the invention. However, the invention is not limited to the above-mentioned embodiments, but various changes and modifications can be made without departing from the sprit and scope of the invention.

For example, an optical sensor is provided on the display unit, so that it can be applied to the display device substrate having an input function. In addition, in the above-mentioned embodiments, the example has been described in which the two source lines are connected to the two terminals of the differential amplifier. The source lines of the different number may be connected to the two terminals of the differential amplifier.

Further, an electro-optical device using the substrate for an electro-optical device of the invention is included in the invention.

For example, in the electro-optical device in which an electro-optical material is interposed between a pair of substrates, the substrate for an electro-optical device is used as one of the pair of substrates.

Figure 26:
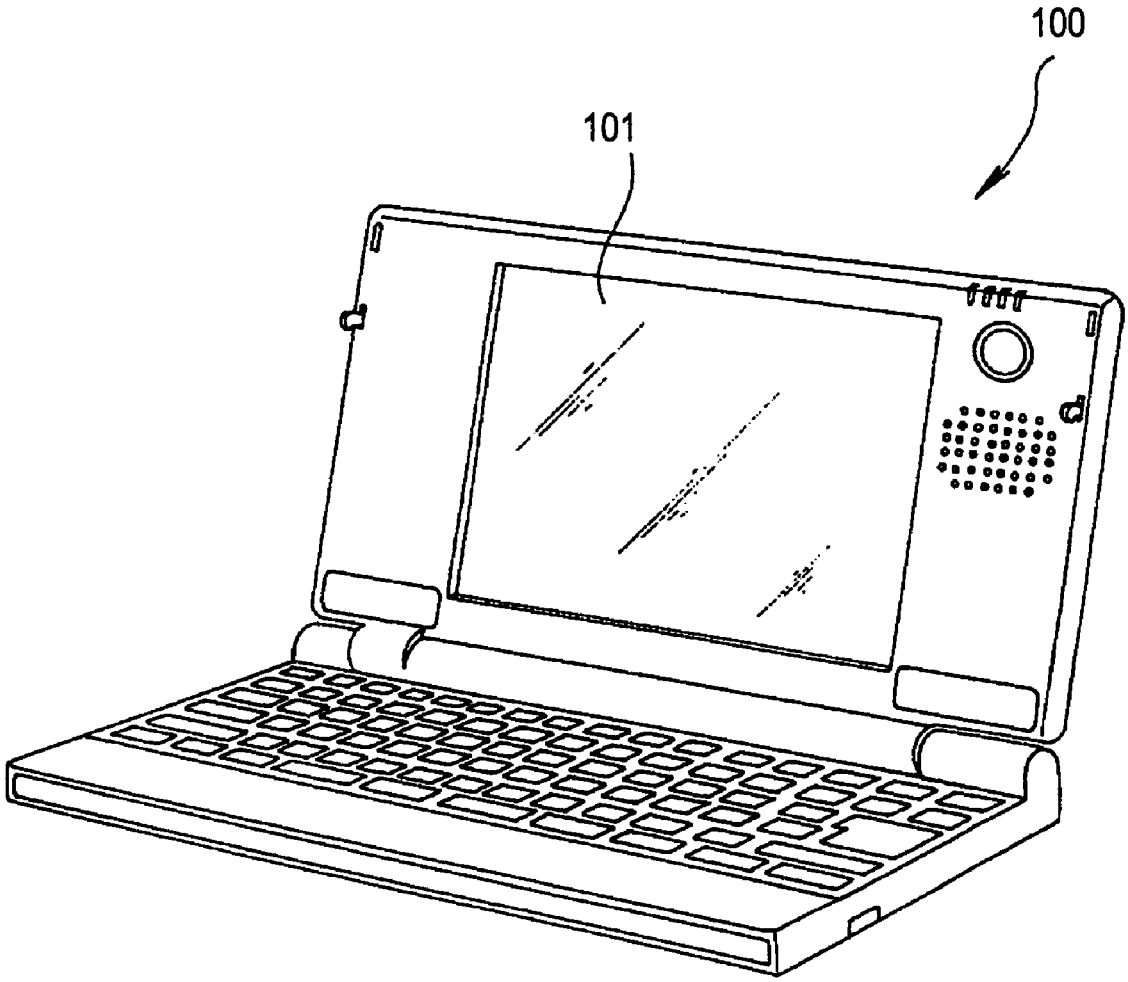
FIG. 26 is a diagram illustrating an appearance of a personal computer which is an example of an electronic apparatus to which the invention is applied.
Figure 27:
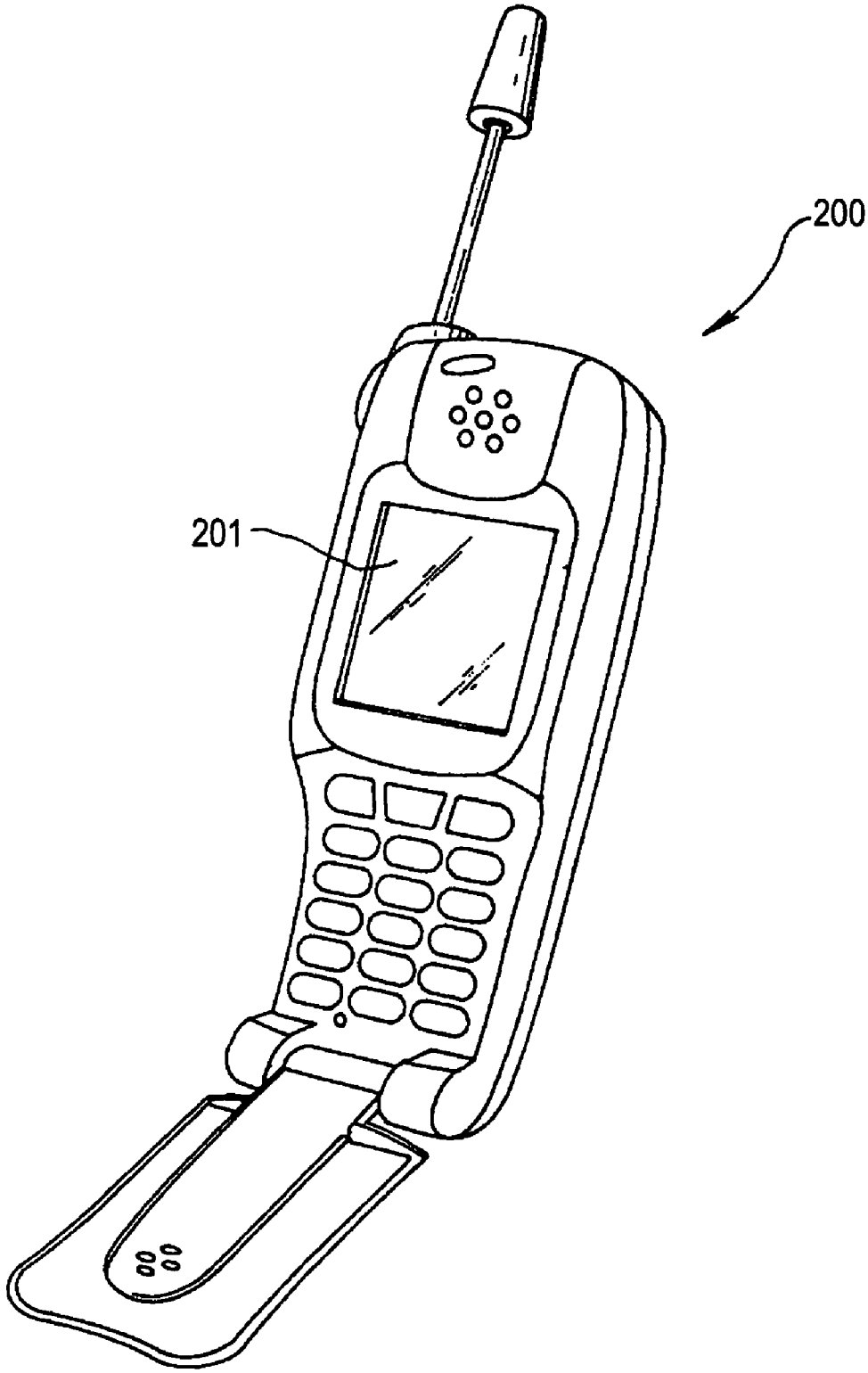
FIG. 27 is a diagram illustrating an appearance of a cellular phone which is an example of an electronic apparatus to which the invention is applied.
Figure 28:
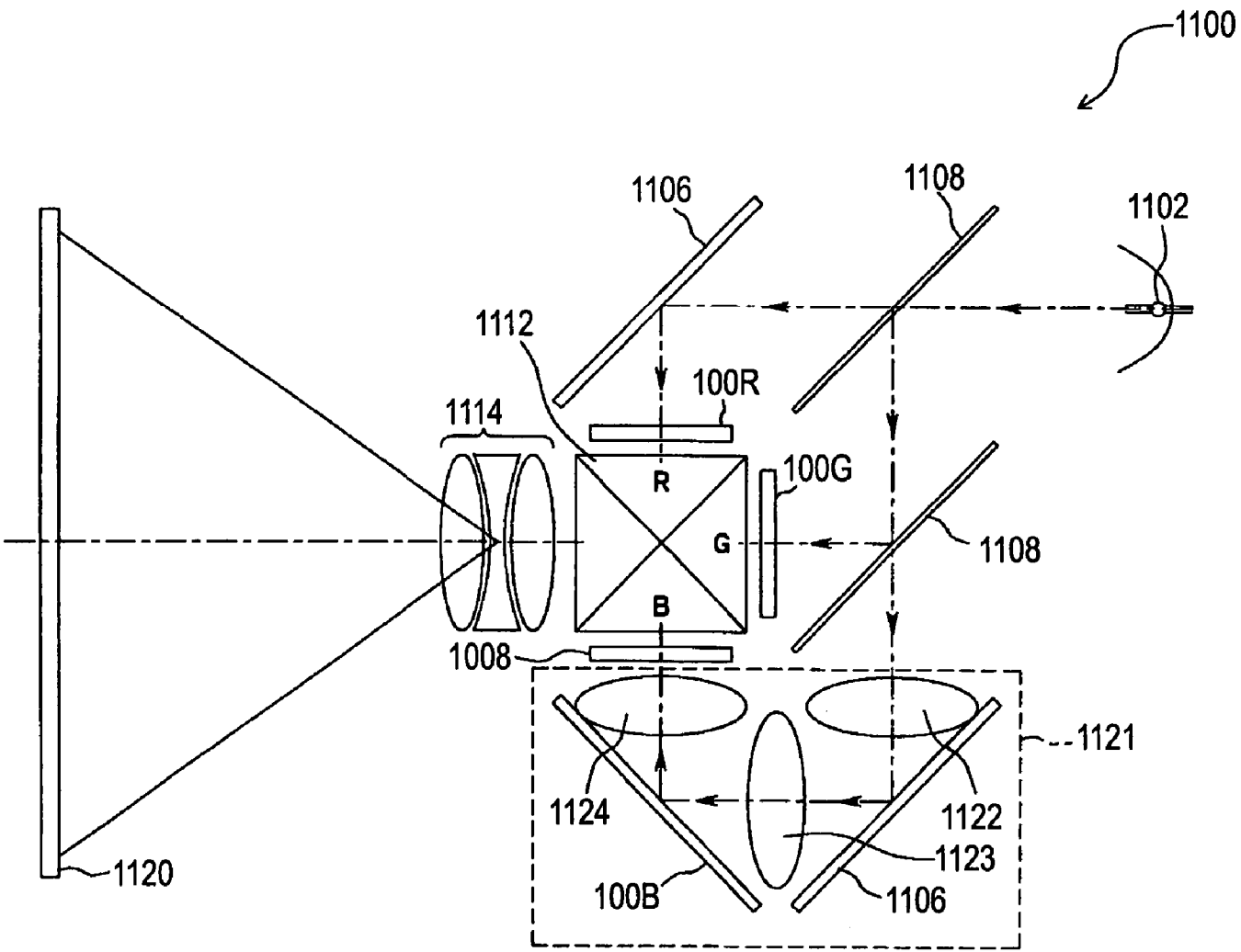
FIG. 28 is a diagram illustrating an appearance of a cellular phone which is an example of an electronic apparatus to which the invention is applied.

In addition, the invention also includes an electronic apparatus in which the above-mentioned electro-optical device is used. FIGS. 26 to 28 are diagrams illustrating an example of the electronic apparatus. FIG. 26 is a diagram illustrating an appearance of a personal computer which is an example of the electronic apparatus. FIG. 27 is a diagram illustrating an appearance of a cellular phone which is an example of the electronic apparatus.

As shown in FIG. 26, the above-mentioned electro-optical device, for example, the liquid crystal display device is used as a display unit 101 of a personal computer 100 as the electronic apparatus. As shown in FIG. 27, the above-mentioned electro-optical device, for example, the liquid crystal display device is used in a display unit 201 of a cellular phone 200 as the electronic apparatus.

FIG. 28 is a diagram illustrating a projection-type color display device which is an example of an electronic apparatus which uses the above-mentioned electro-optical device as a light valve.

In FIG. 28, a liquid crystal projector 1100 which is an example of the projection-type color display device according to the present embodiment has a structure in which three liquid crystal modules each including a liquid crystal device having a driving circuit mounted on a TFT array substrate are prepared and the three liquid crystal modules are used as light valves 100R, 100G, and 100B for RGB. In the liquid crystal projector 1100, if projection light is emitted from a lamp unit 1102 of a white light source such as a metal halide lamp, it is divided into light components R, G, and B corresponding to three primary colors of RGB by three mirrors 1106 and two dichroic mirrors 1108 in order to be guided to the light valves 100R, 100G, and 100B corresponding to the individual colors. At this time, the B light component is guided through a relay system 1121 composed of an incidence lens 1122, a relay lens 1123 and an emitting lens 1124 in order to prevent optical loss due to a long optical path. In addition, the light components corresponding to the three primary colors modulated by the light valves 100R, 100G, and 100B are synthesized again by a dichroic prism 1112, and are then projected onto a screen 1120 through the projection lens 1114 as a color image.

Further, examples of the electronic apparatus may include a television, a view-finder-type or a monitor-direct-view-type vide tape recorder, a car navigation device, a pager, an electronic note, an electronic calculator, a word processor, a work station, a video phone, a POS terminal, a digital still camera, an apparatus having a touch panel, and so forth. It is needless to say that the display panel according to the invention is applied to the above-mentioned various electronic apparatuses.

The invention is not limited to the above-mentioned liquid crystal display device having the TFT, but may be applied to an active-matrix-driven display device.

What is claimed is:

1. A substrate for an electro-optical device comprising:

a plurality of scanning lines;

a plurality of signal lines that are provided so as to cross the plurality of corresponding scanning lines;

a plurality of pixel electrodes that are disposed in a matrix so as to correspond to intersections of the plurality of scanning lines and the plurality of signal lines;

a plurality of amplifiers each of which has a first node and a second node, the first node being electrically connected to a corresponding signal line and being input with a first potential signal supplied to a corresponding pixel electrode, the second node being input with a second potential signal serving as a reference potential, each amplifier comparing a potential of the first potential signal with a potential of the second potential signal, and outputting signals corresponding to the potential of the first node being decreased when the first potential signal is low, and corresponding to the potential of the first node being increased when the first potential signal is high, each amplifier being provided such that at least two signal lines of the plurality of signal lines correspond to one of the first and second nodes;

a selection unit that selects one signal line of the at least two signal lines; and a connection unit that electrically connects the selected signal line to the one of the first and second nodes of the amplifier.

2. The substrate for an electro-optical device according to claim 1, wherein, in each amplifier, the first node corresponds to the at least two signal lines, the second node corresponds to at least two other signal lines, and a number of signal lines in the at least two signal lines and a number of signal lines in the at least two other signal lines are the same.

3. The substrate for an electro-optical device according to claim 1, wherein, in each amplifier, the second node is electrically connected to a supply line for supplying the second potential signal.

4. The substrate for an electro-optical device according to claim 1, wherein the selection unit has a decode circuit that generates an output signal for determining signal lines connected to the first node or the second node of the amplifier on the basis of selection information.

5. An eleetro-optical device comprising:

a pair of substrates; and an electro-optical material that is inserted between the pair of substrates, wherein the substrate for an electro-optical device according to claim 1 is used as one of the pair of substrates.

6. An electronic apparatus comprising the electro-optical device according to claim 5.

7. A method of testing a substrate for an electro-optical device which includes a plurality of scanning lines, a plurality of signal lines that are provided so as to cross the plurality of corresponding scanning lines, and a plurality of pixel electrodes that are disposed in a matrix so as to correspond to intersections of the plurality of scanning lines and the plurality of signal lines, the method comprising:

in a plurality of amplifiers each of which has a first node and a second node, the first node being electrically connected to a corresponding signal line and being input with a first potential signal supplied to a corresponding pixel electrode, the second node being input with a second potential signal serving as a reference potential, each amplifier being provided such that at least two signal lines of the plurality of signal lines correspond to one of the first and second nodes, selecting one signal line of the at least two signal lines;

electrically connecting the selected one signal line to the corresponding first or second node;

supplying the first potential signal supplied to the pixel to one of the first and second nodes through the electrically connected signal line while supplying the second potential signal to the other; and outputting signals such that by comparing a potential of the first potential signal with a potential of the second potential signal, the potential of the first node is decreased when the first potential signal is low, and the potential of the first node is increased when the first potential signal is high.

* * * * *